US008122746B2

(12) United States Patent
Hyatt, Jr.

(10) Patent No.: US 8,122,746 B2
(45) Date of Patent: Feb. 28, 2012

(54) ELECTROMECHANICAL CYLINDER PLUG

(76) Inventor: Richard G. Hyatt, Jr., Shawsville, VA (US)

( * ) Notice: Subject to any disclaimer, the term of this patent is extended or adjusted under 35 U.S.C. 154(b) by 521 days.

(21) Appl. No.: 11/892,305

(22) Filed: Aug. 21, 2007

(65) Prior Publication Data

US 2007/0289346 A1 Dec. 20, 2007

Related U.S. Application Data

(62) Division of application No. 08/720,070, filed on Sep. 27, 1996.

(60) Provisional application No. 60/004,594, filed on Sep. 29, 1995, provisional application No. 60/011,764, filed on Feb. 12, 1996.

(51) Int. Cl.
*E05B 49/00* (2006.01)

(52) U.S. Cl. ..... 70/278.3; 70/495; 70/277; 70/283.1; 70/278.7; 70/369; 340/5.2; 340/5.6

(58) Field of Classification Search ..... 70/277, 70/278, 278.2, 278.3, 280–283, 375, 389, 70/492, 493, 495, 496, 278.1, 278.7, 283.1, 70/367–369; 340/5.6, 825.31, 5.2
See application file for complete search history.

(56) References Cited

U.S. PATENT DOCUMENTS

| | | | |
|---|---|---|---|
| 480,299 | A | 8/1892 | Voight |
| 550,111 | A | 11/1895 | Sargent |
| 564,029 | A | 7/1896 | Sargent |
| 2,105,304 | A | 1/1938 | Wagner |
| 2,613,258 | A | 10/1952 | Azano |
| 3,208,248 | A | 9/1965 | Tornoe |
| 3,241,344 | A | 3/1966 | Peters |
| 3,287,944 | A | 11/1966 | Crumb |
| 3,722,240 | A | 3/1973 | Spain et al. |
| 3,733,862 | A | 5/1973 | Killmeyer |
| 3,748,878 | A | 7/1973 | Balzano et al. |
| 3,797,936 | A | 3/1974 | Dimitriadis |
| 3,848,229 | A | 11/1974 | Perron et al. |
| 3,851,314 | A | 11/1974 | Hedin |

(Continued)

FOREIGN PATENT DOCUMENTS

| | | |
|---|---|---|
| CH | 653 400 | 12/1985 |

(Continued)

OTHER PUBLICATIONS

US 5,722,274, 03/1998, Nakauchi et al. (withdrawn).

*Primary Examiner* — Suzanne Barrett
(74) *Attorney, Agent, or Firm* — Robert R. Bushnell, Esq.

(57) ABSTRACT

An electromechanical locking mechanism provides a plug with a rekeyable primary lock mechanism such as a tumbler stack, an electromechanical operator such as a solenoid or a motor, and an electronic circuit having a memory, or an electronic memory and an electronic logic stage, controlling activitiation and operation of the electromechanical operator, contained entirely within the plug. Insertion of a blade of a key that is properly profiled and bitted to correctly displace the primary lock assembly relative to a cylinder encasing the plug, and application by the key of electrical power, or of electrical power and a correct data signal, to the electronic circuit, will cause activation of the electrical operator and repositioning of a distal member of the operator relative to the cylinder, and thereby enable torque manually applied to the blade of the key to rotate the plug within the cylinder.

6 Claims, 20 Drawing Sheets

U.S. PATENT DOCUMENTS

| | | | | |
|---|---|---|---|---|
| 3,889,501 | A | | 6/1975 | Fort |
| 3,979,647 | A | | 9/1976 | Perron et al. |
| 4,053,939 | A | | 10/1977 | Nakauchi et al. |
| 4,073,527 | A | | 2/1978 | Schlage |
| 4,144,523 | A | | 3/1979 | Kaplit |
| 4,200,227 | A | | 4/1980 | Lemelson |
| 4,209,782 | A | | 6/1980 | Donath |
| 4,257,030 | A | | 3/1981 | Bruhin |
| 4,326,124 | A | | 4/1982 | Faude |
| 4,393,673 | A | | 7/1983 | Widen |
| 4,414,831 | A | | 11/1983 | Perkut |
| 4,415,893 | A | | 11/1983 | Roland et al. |
| 4,416,127 | A | * | 11/1983 | Gomez-Olea Naveda ..... 70/276 |
| 4,432,142 | A | | 2/1984 | Korsak |
| 4,433,487 | A | | 2/1984 | Roland |
| 4,458,512 | A | | 7/1984 | Gelhard |
| 4,484,462 | A | | 11/1984 | Berkowitz |
| 4,485,648 | A | | 12/1984 | Rabinow |
| 4,509,093 | A | | 4/1985 | Stellberger |
| 4,562,343 | A | | 12/1985 | Wiik et al. |
| 4,562,712 | A | | 1/1986 | Wolter |
| 4,602,253 | A | | 7/1986 | Kreft |
| 4,620,088 | A | | 10/1986 | Files |
| 4,658,105 | A | | 4/1987 | Seckinger |
| 4,659,915 | A | | 4/1987 | Files |
| 4,663,952 | A | | 5/1987 | Gelhard |
| 4,686,358 | A | | 8/1987 | Sekinger |
| 4,712,398 | A | | 12/1987 | Clarkson |
| 4,723,427 | A | | 2/1988 | Oliver |
| 4,727,369 | A | | 2/1988 | Rode et al. |
| 4,732,022 | A | | 3/1988 | Widen |
| 4,789,859 | A | | 12/1988 | Clarkson et al. |
| 4,798,068 | A | | 1/1989 | Nakauchi |
| 4,823,575 | A | | 4/1989 | Florian |
| 4,833,465 | A | | 5/1989 | Abend et al. |
| 4,848,115 | A | | 7/1989 | Clarkson et al. |
| 4,854,619 | A | | 8/1989 | Nakauchi |
| 4,856,310 | A | | 8/1989 | Parienti |
| 4,864,292 | A | | 9/1989 | Nieuwkoop |
| 4,891,636 | A | | 1/1990 | Rieker |
| 4,909,053 | A | | 3/1990 | Zipf, III et al. |
| 4,916,927 | A | | 4/1990 | O'Connell et al. |
| 4,979,647 | A | | 12/1990 | Hassell |
| 5,003,801 | A | | 4/1991 | Stinar et al. |
| 5,010,750 | A | | 4/1991 | Boser et al. |
| 5,038,023 | A | | 8/1991 | Saliga |
| 5,089,692 | A | | 2/1992 | Tonneson |
| 5,131,038 | A | | 7/1992 | Puhl et al. |
| 5,148,691 | A | | 9/1992 | Wallden |
| 5,206,637 | A | | 4/1993 | Warren |
| 5,218,188 | A | | 6/1993 | Hanson |
| 5,228,730 | A | | 7/1993 | Gokcebay et al. |
| 5,245,329 | A | | 9/1993 | Gockcebay |
| 5,337,588 | A | | 8/1994 | Chhatwal |
| 5,351,042 | A | | 9/1994 | Aston |
| 5,367,295 | A | | 11/1994 | Gokcebay et al. |
| 5,469,727 | A | | 11/1995 | Spahn et al. |
| 5,477,213 | A | | 12/1995 | Atarashi |
| 5,507,162 | A | | 4/1996 | Chhatwal |
| 5,540,069 | A | | 7/1996 | Muller et al. |
| 5,542,274 | A | | 8/1996 | Thordmark et al. |
| 5,552,777 | A | | 9/1996 | Gokcebay et al. |
| 5,605,066 | A | | 2/1997 | Hurskainen |
| 5,605,067 | A | | 2/1997 | Juan |
| 5,614,703 | A | | 3/1997 | Martin et al. |
| 5,628,217 | A | | 5/1997 | Herrera |
| 5,708,308 | A | | 1/1998 | Katayama et al. |
| 5,717,147 | A | | 2/1998 | Basch et al. |
| 5,749,253 | A | | 5/1998 | Glick et al. |
| 5,839,305 | A | | 11/1998 | Aston |
| 5,839,307 | A | | 11/1998 | Field et al. |
| 6,000,609 | A | | 12/1999 | Gocebay et al. |
| 6,363,762 | B1 | | 4/2002 | Kueng |
| 6,374,653 | B1 | | 4/2002 | Gokcebay et al. |
| 6,552,650 | B1 | | 4/2003 | Gokcebay et al. |
| 6,564,601 | B2 | * | 5/2003 | Hyatt, Jr. ..... 70/278.3 |
| 6,615,625 | B2 | | 9/2003 | Davis |
| 6,684,671 | B2 | | 2/2004 | Beylotte et al. |

FOREIGN PATENT DOCUMENTS

| | | |
|---|---|---|
| CH | 653400 | 12/1985 |
| DE | 559158 | 9/1932 |
| DE | 2546542 | 4/1977 |
| DE | 2557637 | 7/1977 |
| DE | 3031405 | 4/1982 |
| DE | 3218112 | 11/1983 |
| DE | 3225754 | 1/1984 |
| DE | 3331357 | 3/1984 |
| DE | 3244566 | 6/1984 |
| DE | 3313098 | 10/1984 |
| DE | 3507871 | 11/1985 |
| DE | 3515888 | 11/1986 |
| DE | 3602989 | 11/1987 |
| DE | 3712300 | 10/1988 |
| DE | 4036575 | 6/1991 |
| DE | 4314854 | 11/1994 |
| EP | 0 059 874 | 9/1982 |
| EP | 0 094 592 | 11/1983 |
| EP | 0 115 747 | 8/1984 |
| EP | 0 243 586 | 11/1987 |
| EP | 278 906 | 8/1988 |
| EP | 278906 | 8/1988 |
| EP | 281 507 | 9/1988 |
| EP | 281507 | 9/1988 |
| EP | 0 290 330 | 11/1988 |
| EP | 303 849 | 2/1989 |
| EP | 303849 | 2/1989 |
| EP | 0 324 096 | 7/1989 |
| EP | 453878 | 10/1991 |
| EP | 0 497 040 | 8/1992 |
| EP | 0 559 158 | 9/1993 |
| EP | 0 597 373 | 5/1994 |
| EP | 453 878 | 5/1995 |
| FR | 2607545 | 6/1988 |
| GB | 864968 | 4/1961 |
| GB | 1531951 | 11/1978 |
| GB | 2124808 | 2/1984 |
| GB | 2155988 | 10/1985 |
| GB | 2174452 | 11/1986 |
| GB | 2 221 714 | 7/1990 |
| GB | 2 226 593 | 7/1990 |
| GB | 2 250 052 | 7/1990 |
| GB | 2 259 737 | 7/1990 |
| GB | 2239673 | 7/1991 |
| GB | 2 243 185 | 10/1991 |
| JP | 63-032072 | 2/1988 |
| JP | 63-093977 | 4/1988 |
| JP | 63-138080 | 6/1988 |
| JP | 63-206581 | 8/1988 |
| JP | 01-219269 | 9/1989 |
| JP | 01-219270 | 9/1989 |
| JP | 02-200979 | 8/1990 |
| JP | 06-073929 | 3/1994 |
| JP | 06-073930 | 3/1994 |
| JP | 06-073931 | 3/1994 |
| JP | 07-317385 | 12/1995 |
| JP | 08-218690 | 8/1996 |
| JP | 09-132977 | 5/1997 |
| WO | WO 81/00586 | 3/1981 |
| WO | WO 87/03640 | 6/1987 |
| WO | WO 96/18014 | 6/1996 |

* cited by examiner

ELECTROMECHANICAL CYLINDER PLUG

CLAIM FOR PRIORITY AND CROSS-REFERENCE TO RELATED APPLICATIONS

This application is a divisional of Applicant's Ser. No. 08/720,070 filed in the U.S. Patent & Trademark Office on 27 Sep. 1996, and assigned to the assignee of the present invention. This application also makes reference to, incorporated the same herein, and claims all benefits accruing under 35 U.S.C. §§119 and 120 from provisional applications entitled Electromechanical Cylinder Plug earlier filed in the United States Patent & Trademark Office on the 29 Sep. 1995 and duly assigned Ser. No. 60/004,594, and filed in the United States Patent & Trademark Office on the 12 Feb. 1996 and duly assigned Ser. No. 60/011,764.

FIELD OF THE INVENTION

This invention relates to access security systems generally, and more particularly, to electromechanical locks and to the plugs and cylinders of electromechanical locks.

BACKGROUND ART

In an effort to both control and monitor access, state-of-the-art contemporary access security systems have begun to electrically couple the hardware of individual locks to a central, or host, computer. This enables the systems at a minimum, to monitor the operation of each lock and more commonly, to additionally control access to the space guarded by each lock by the expedient of controlling, or at least regulating operation of individual locks. Although some systems rely simply either wholly, or partially, upon recognition of a code borne by a pass, or credential, that contains a memory (e.g., a magnetic strip or embedded memory chip) bearing a code unique to the pass, more elaborate systems such as the ELECTRONIC SECURITY SYSTEM of R. G. Hyatt, Jr., et al. disclosed in U.S. Pat. No. 5,140,317 issued on 18 Aug. 1992, use both an electronic lock mechanism and an electronic key, both of which are provided with a microprocessor and a memory storing an identification code. More recent efforts such as the DUAL CONTROL MODE LOCK of T. J. DiVito, et al., U.S. Pat. No. 5,423,198 issued on 13 Jun. 1995, endeavors to further enhance access security by first having the blade of a key bearing the correct profile and bitting transmit an enable signal upon insertion into the keyway of a particular rekeyable locking mechanism, and then having a second coded signal electromagnetically displace one or more pin tumbler stacks to enable rotation of the plug relative to the cylinder.

It has been my observation that these access security systems tend to require complete replacement of each previously installed locking mechanism. I have found that this is not always feasible because some locks have a cylinder formed as an integral part of the secured item (e.g. a hospital drug cart), while other items and areas lack sufficient space to accommodate replacement of an existing mechanical lock with the larger volume of a contemporary electromechanical lock. Moreover, contemporary electromechanical lock systems typically require that each lock be electrically wired into a network with either a source of power or a data or control bus. While this is possible with many architectural applications and with secured items such as a coin box of a pay telephone, in other situations I have found that either the remote location of the lock, the difficulty in stringing the necessary wiring, or customs in the particular industry concerning placement of a lock on the secured item, or area, make the installation of an electromechanical lock that is wired into a network impractical.

I have also noticed that both the expense of the complete replacement of each locking mechanism and the expense of the replacement electromechanical locking system have limited the market for such systems to users where either enhanced security is paramount (e.g., hospital drug cabinets) or excess system costs are not a disadvantage because the user (e.g. a regulated utility such as a telephone company that installs electromechanical locks on the coin boxes of its pay telephones) is able to claim an annual return based upon the cost of savings generated by the system. I have discovered that although both classes of users would be able to attain the same level of security from less elaborate systems, the willingness of such users to readily bear these costs as well as the ages old illusion of security concomitant with expense, has hidden the possibility of improving upon current access security systems.

Moreover, I have found that despite their innate complexity, many contemporary electromechanical lock systems are able to provide only a single level of access security; thus the cost of equipping each user to use a particular lock remains the same—each user must have the same expensive battery powered microprocessor controlled key, despite the fact that different users of that lock may have different levels of access via that lock. Loss or damage of the microprocessor controlled key can not, in my observation, be minimized by the owner of the lock. Furthermore, electromechanical locking systems tend, because of their excessively elaborate designs, to be unique to their manufacturers. Accordingly, users become captive to their initially selected manufacturer. Consequently, other potential classes of users subject to considerations of costs for replacement of existing locks, costs of the replacement systems as well as costs of operation of the replacement and costs of periodic repair and maintenance, have been denied the benefits of less expensive electromechanical locking systems able to provide the same level of access security, despite the fact that security is also a paramount concern of such users (e.g. a prison or other governmentally funded institution).

SUMMARY OF THE INVENTION

It is therefore, one object to the present invention to provide a more sophisticated electromechanical locking mechanism.

It is another object to provide a plug suitable to readily convert an existing locking mechanism into an electromechanical locking mechanism.

It is still another object to provide a replacement plug able to incorporate an locking mechanism into an electromechanical locking system.

It is yet another object to provide an electromechanical locking system able to accommodate a hierarchy of access security requirements.

It is still yet another object to provide lock components enabling retrofitting of an existing locking mechanism with an electromechanical locking mechanism, without requiring replacement of all of the components of the existing locking mechanism.

It is a further object to provide lock components enabling conversion of an existing locking mechanism into an electromechanical locking system, by replacing less than all of the components of the existing locking mechanism.

It is a still further object to provide an electromechanical plug that, with a minor alteration of a lock's cylinder, enables the lock to be incorporated into an electromechanical locking system.

It is a yet further object to provide an electromechanical lock able to be set to a plurality of operationally locked, unlocked, and partially bypassed conditions.

It is a still yet further object to provide an electromechanical plug that enables each lock to be individually set, either locally or remotely, to grant access to a secured item or area in response to any one of a plurality of keys providing a plurality of different keys levels of operational access.

It is also an object to provide an electromechanical locking mechanism having its electronic circuits and all of its electromechanical actuating elements incorporated wholly into the body of a plug.

It is an additional object to provide an electromechanical locking mechanism that is amenable for use both as one lock within an electrical network of electromechanical locks and alone independently of any host electrical power or control network.

It is a still additional object to provide a drop-in substitute plug able to convert contemporary cylindrical locks into electromechanical locks able to provide a plurality of different levels of access security.

These and other objects may be achieved with a hierarchically adaptable lock using a removable cylindrical plug rotatably held with a lock cylinder of a locking mechanism. The plug has an exposed terminal face base perforated by a keyway and a distinct electrical contact aperture. The plug contains either a mechanical locking mechanism, such as a rekeyable tumbler stack, and an electrical operator, or simply a key retaining mechanism and an electrical operator, wholly within the cylindrical exterior surface of the plug. The opposite base of the plug operationally supports a tailpiece able to rotate a cam and position a bolt of the locking mechanism. After insertion of a blade of a properly bitted and profiled key, electrical power, or alternatively electrical power and a data signal superimposed upon the electrical power, may be transmitted from electrical circuits of the key to the electrical operator within the plug. Activation of the electrical operator within the plug, in conduction with correct displacement of the mechanical locking mechanism, or in the embodiments constructed without a mechanical locking mechanism, simply activation of the electrical operator, enables rotation of the plug within the cylinder as torque is manually applied to the blade of the key. An electronic memory, or an electronic memory and an electronic logic circuit wholly contained within the plug, may be electrically interposed between the electrical operator and the electrical contacts receiving power, or power and data signals, from the key.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
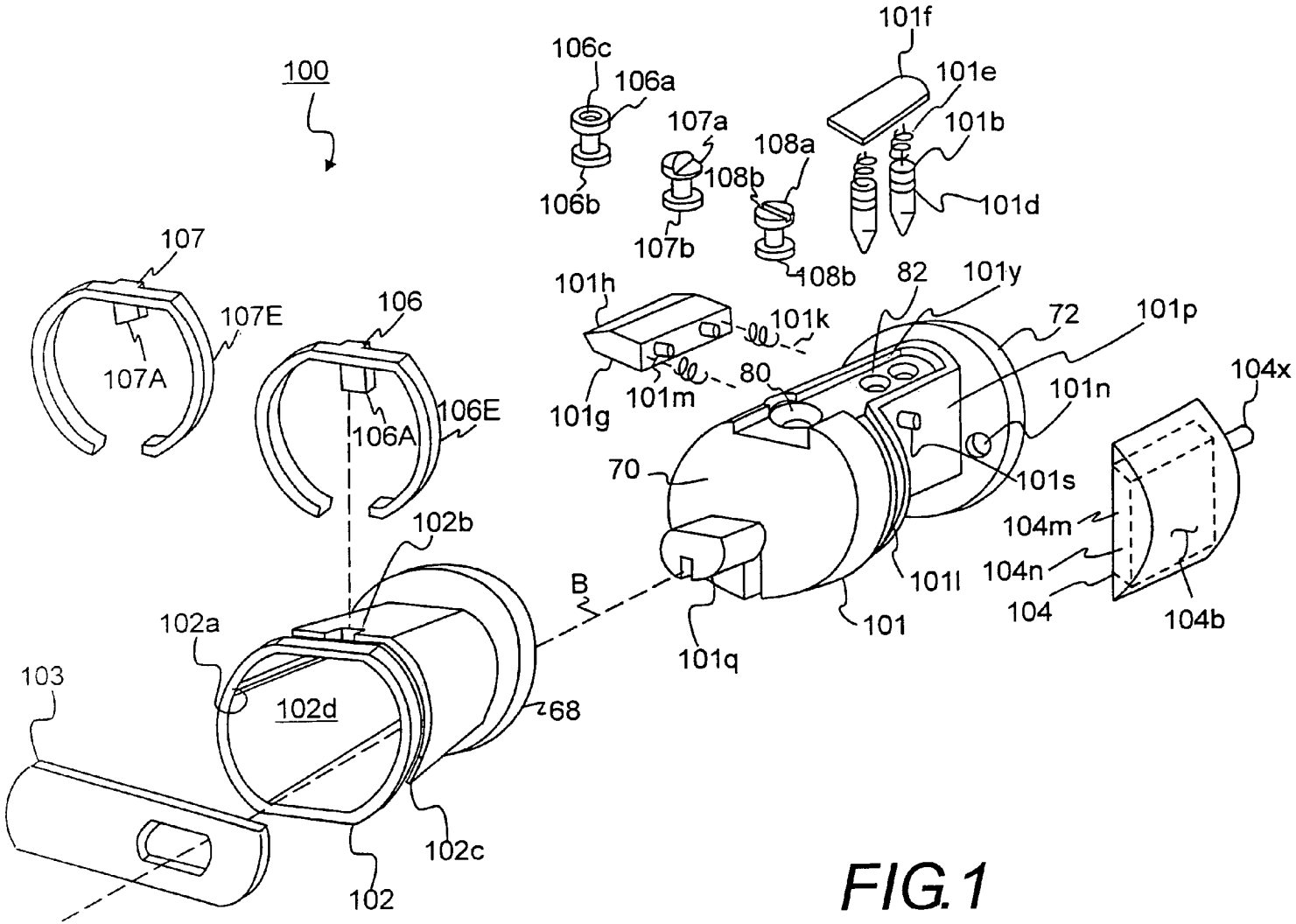
FIG. 1 is an exploded perspective view showing the details of a structure able to support several alternative embodiments of a lock constructed according the to principles of the present invention.
Figure 10:
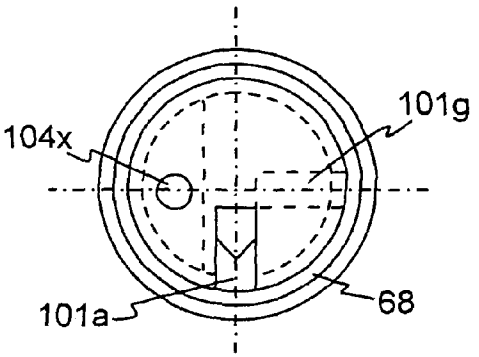
FIG. 10 is a front elevational view illustrating some of the details of the embodiments of FIG. 1.
Figure 11:
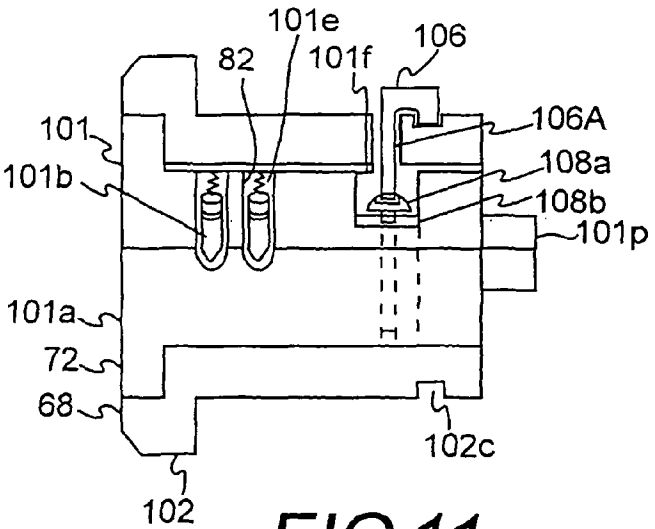
FIG. 11 is a side cross-sectional elevational view illustrating some of the details of the embodiments of FIG. 1.
Figure 9:
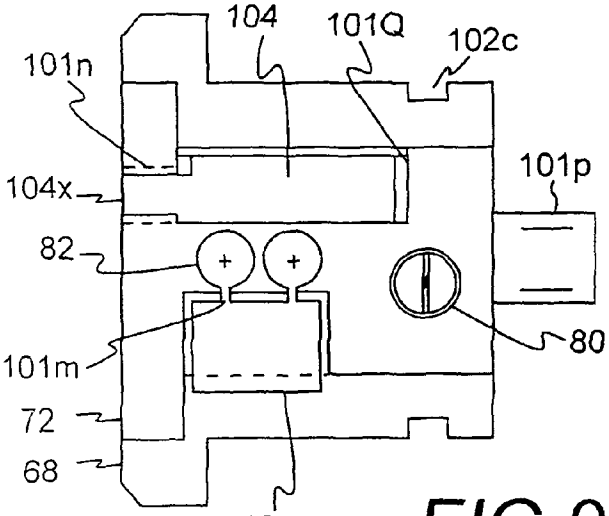
FIG. 9 is an upper plan cross-sectional view illustrating some of the details of the embodiments of FIG. 1.
Figure 12:
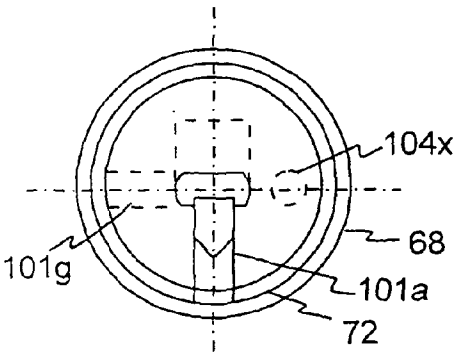
FIG. 12 is a rear elevational view illustrating some of the details of the embodiments of FIG. 1.
Figure 13:
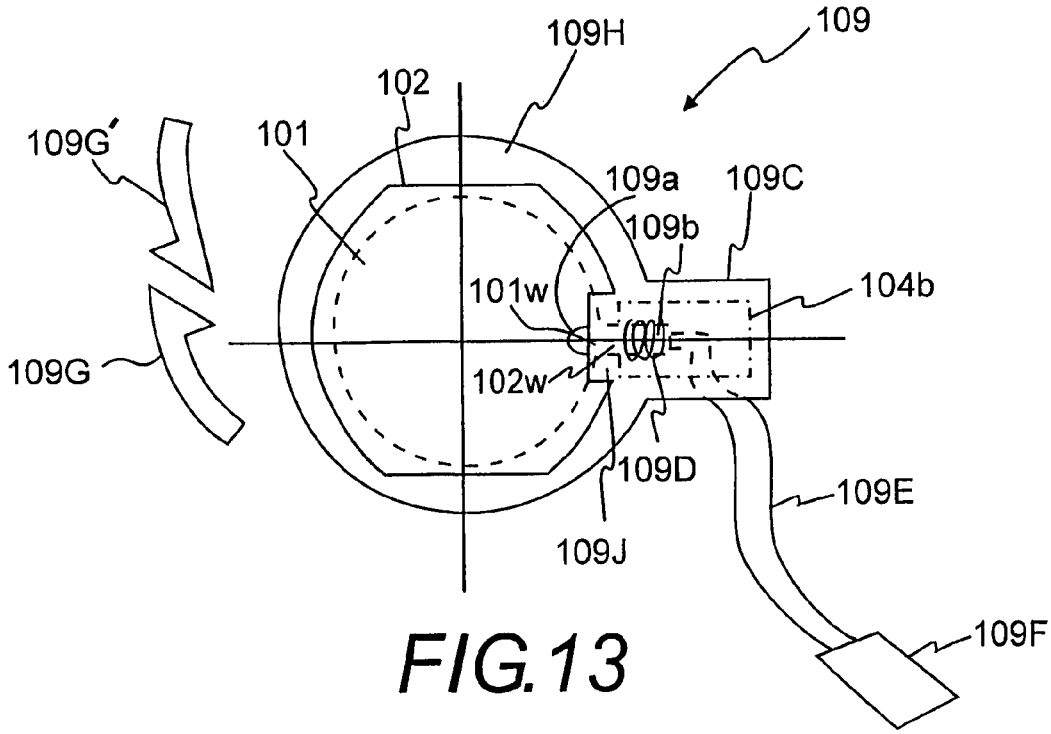
FIG. 13 is an enlarged cross-sectional detailed view showing the structure of an alternative embodiment constructed according to the principles of the present invention.
Figure 14:
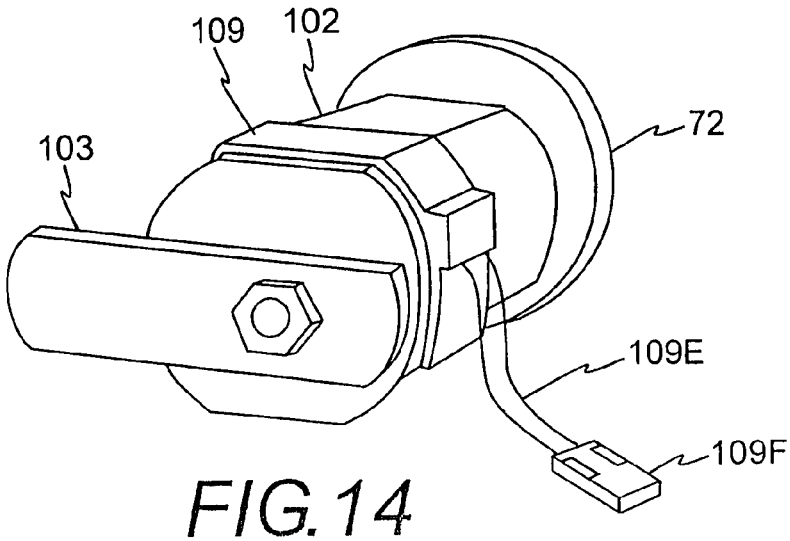
FIG. 14 is an oblique perspective view of an assembled alternative embodiment constructed according to the principles of the present invention.
Figure 15:
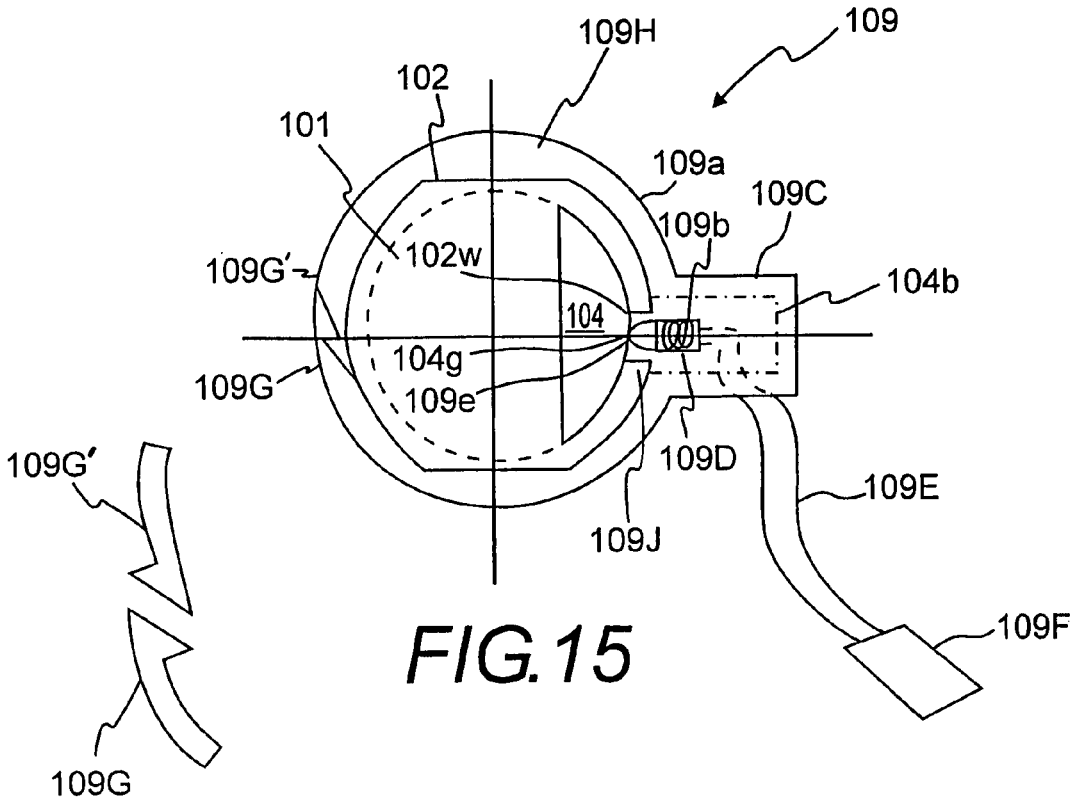
FIG. 15 is a cross-sectional detailed view showing the structure of an alternative embodiment constructed according to the principles of the present invention.
Figure 16:
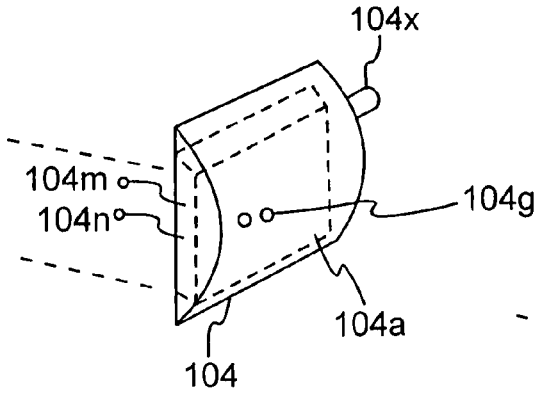
FIG. 16 is an oblique view showing details of a case for a logic circuit that may be incorporated into several of the embodiments of the present invention.
Figure 17:
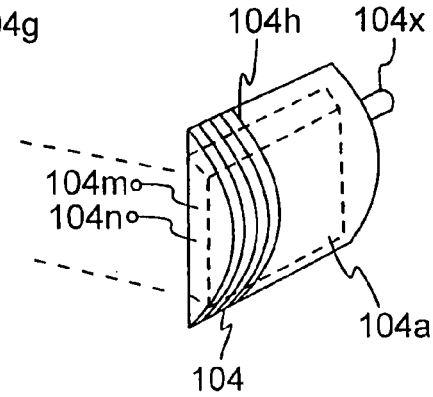
FIG. 17 is an oblique view showing details of an alternative embodiment of a case for a logic circuit that may be incorporated into several of the embodiments of the present invention.

Turning now to the drawings, FIG. 1 provides an exploded perspective view of a cylindrical camlock 100 of the type in general use for securing access to cabinet doors, drawers and coin boxes. The principles illustrated by camlock 100 are however, readily suitable for other types of locks. As shown in the various views of FIGS. 1 through 18, a camlock is assembled with an elongate, cylindrical plug 101 inserted inside the cylindrical cavity 102*d* of cylinder shell, or body, 102. Typically, lock 100 is constructed with end plate 68 at the terminal end of cylinder 102, recessed to receive face plate 72 of plug 101 so that the exposed surface of plug 101 lies flush with the face of plate 72. Absent such key retaining components (i.e., those components of the plug that 3 retain the shank of a key (e.g., such as bitted key 200) within the keyway while the plug is rotated from its rest position relative to the shell 102) of the locking mechanism as cylindrical pins 101*b* and sidebar 101*g*, plug 101 should be sized to freely rotate around an axis that is parallel to the longitudinal axis of cavity 102*d*. Plug 101 contains an axially elongated keyway passage 101*a* shown in the front, cross-sectional and rear views of FIGS. 10, 11 and 12, respectively, extending 8 axially through the exposed front plate 72 of cylindrical plug 101. Keyway passage 101*a* is configured to accommodate reciprocal insertion of the blade of a key 200 that has been correctly profiled to conform to the profile of keyway 101*a*. Although not essential to the practice of all embodiments of the principles of this invention, plug 101 may also contain a mechanical locking mechanism such as a set of pin tumblers 101*b* of the type mentioned in U.S. Pat. Nos. 3,722,240 and 3,499,303 to Oliver. Pin tumblers 101*b* are biased by springs 101*e* into the bottom of corresponding pin chambers 82 by corresponding separate springs 101*e* restrained within the body of plug 101 by coverplate 101*f* fitted snugly into an axially extending slot 101*y* adjacent to the exterior circumferential surface of plug 101.

Plug 101 also contains sidebar 101*g* tapered into an acute (frequently blunted), axially extending bearing edge 101*h* partially recessed into a slot 102*a* formed axially along the exterior circumferential surface of cylinder 102. Sidebar 101*g* is typically biased radially outwardly by one or more springs 101*k* so that the leading axially extending edge 101*h* of sidebar 101*g* protrudes into 101*a* beveled slot 102*a* of a cylinder 102 encasing plug 101 after the complete plug 101 has been installed into cylinder 102. Pins 101*b* are cut in this particular embodiment with a groove 101*d*. When the blade of a mechanical key that has been bitted to correctly displace pins 101*b* radially outwardly from keyway 101*a* within their corresponding chambers 82 is inserted with the cuts of the land of the key precisely matching the coding (axial separation between the upper and lower portions of pins 101*b*) of pins 101*b*, then slots 101*d* will align with the legs, or pegs, 101*m* of the sidebar 102*g*. When rotational torque is manually applied to the key by the user, the beveled edges of slot 102*a* enables sidebar 101*g* to move radially inwardly and away from groove 102*a* against the bias of springs 101*k* slightly, but enough to allow plug 101 to rotate within cylinder 102, thus concomitantly rotating tailpiece 101*q* which, in turn, rotates a movable cam 103 or other member engaged by tailpiece 101*q*. In other applications, cam 103 may be connected to and, upon rotation of plug 101 and its tailpiece 101*q*, draw a bolt and thereby permit access to a secured item or into a secured area. Other embodiments allow a tailpiece 101*q* with a particular shape to drive a clutch, cam or linkage.

The user may then rotate the key until plug 101 is aligned with a key extraction point where alignment between chambers 82 and the corresponding tumbler pins 101*b* allow the bias of springs 101*k* to force sidebar 101*g* radially outwardly until beveled edge 101*h* mates with slot 102*a*, and thus permits withdrawal of key 200 from keyway 101*a*. A cylinder lock of this type may have two or more grooves, or slots 102*a* spaced arcuately apart to provide several arcuately separate points at which a key may be extracted from plug 101. When pins 101*b* are engaged in the properly manufactured corresponding cuts in the blade of the key and each of pins 101*b* is correspondingly radially displaced outwardly within its chamber, and legs, or pegs, 101*m* of sidebar 101*g* engage corresponding circular grooves 101*d* formed in some, or all, of pins 101*b* as those pins 101*b* are forced radially outward by the bits of the key. The interengagement of pegs 101*m* and grooves 101*d* prevents radial movement of pins 101*b* and the concomitant release of the blade of the key within keyway 101*a*; the blade may only be extracted from keyway 101*a* when beveled edge 101*h* of sidebar 101*g* is correctly aligned with groove 102*a*. It should be noted that features of mechanical lock and key mechanisms other than those mentioned in U.S. Pat. Nos. 3,722,240 and 3,499,303 to Oliver may be used in the practice of the instant invention.

Figure 2:
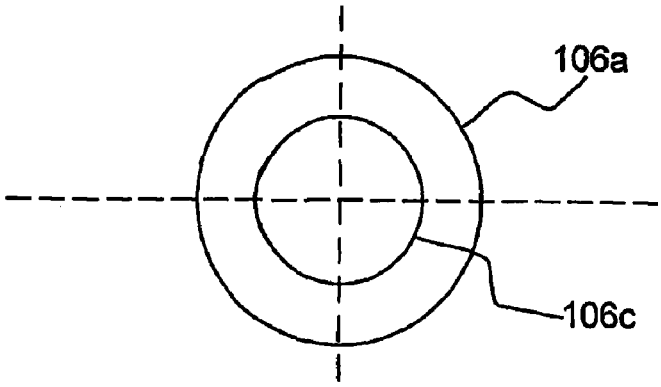
FIG. 2 is a top detailed view of an electrical operator of a type suitable for use in the embodiments shown in FIG. 1.
Figure 3:
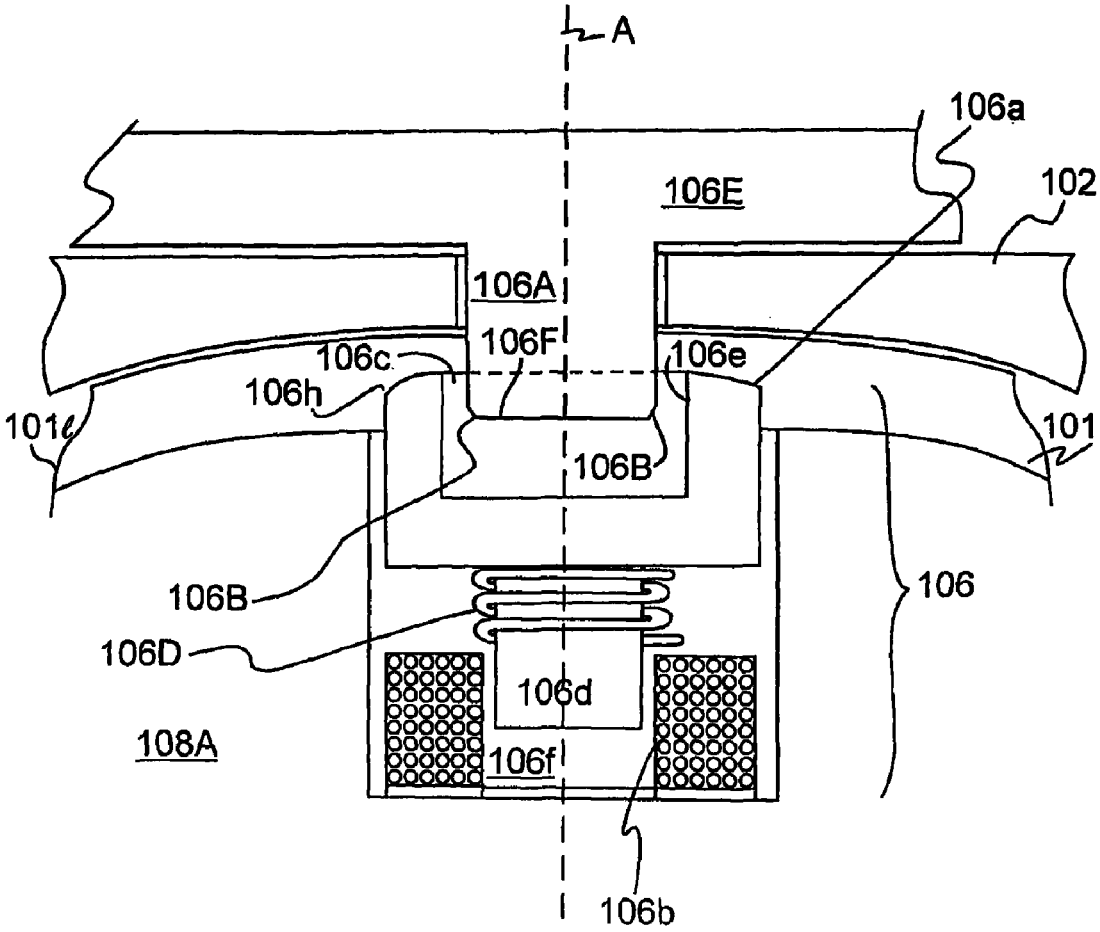
FIG. 3 is an enlarged cross-sectional detail view showing the structure of a first embodiment of a lock constructed according the to principles of the present invention.
Figure 4:
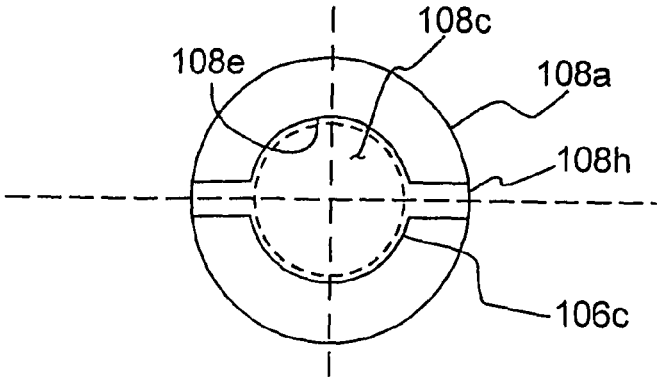
FIG. 4 is a top detailed view of one armature of an electrical operator of a type suitable for use in the embodiments shown in FIG. 1.
Figure 5A:
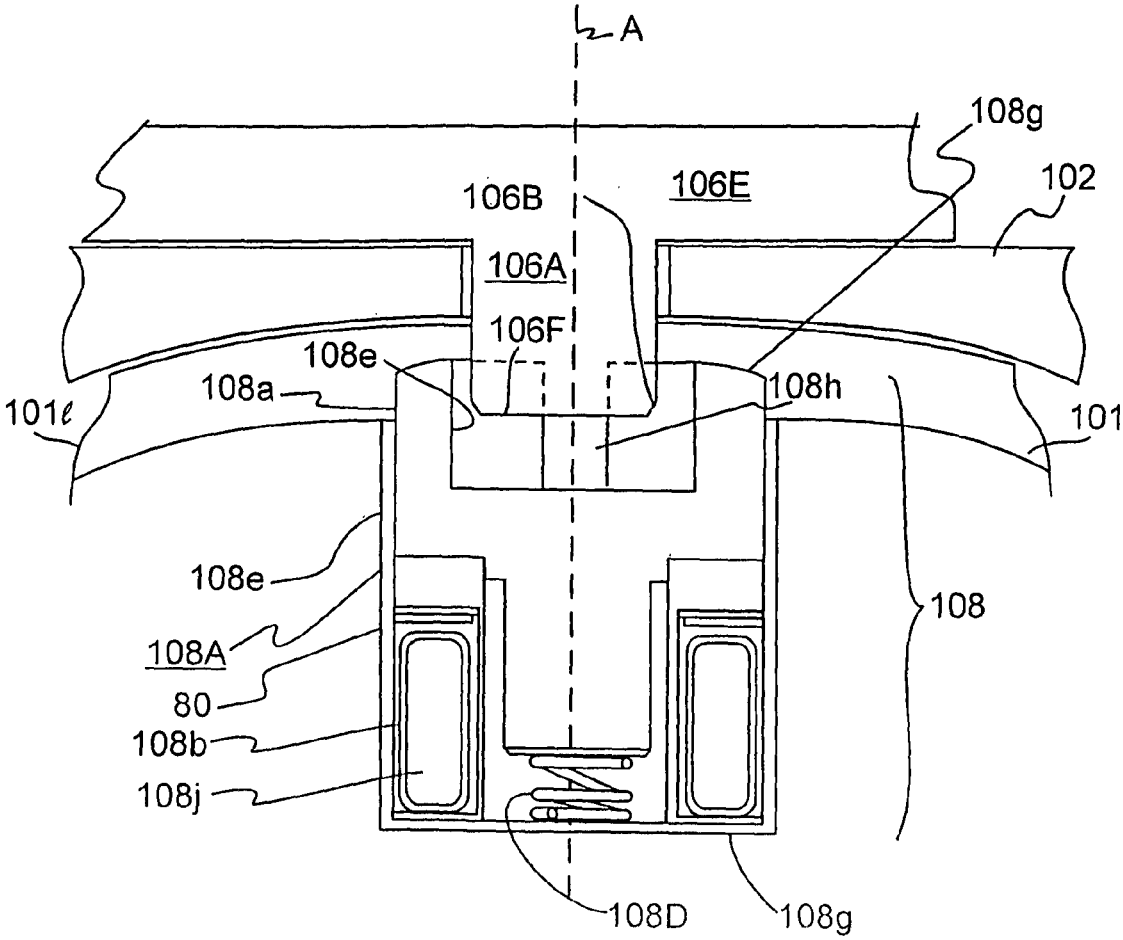
FIGS. 5A and 5B are two enlarged cross-sectional detailed views showing two different operational positions of the structure of a second embodiment of a lock constructed according to the principles of the present invention.
Figure 5B:
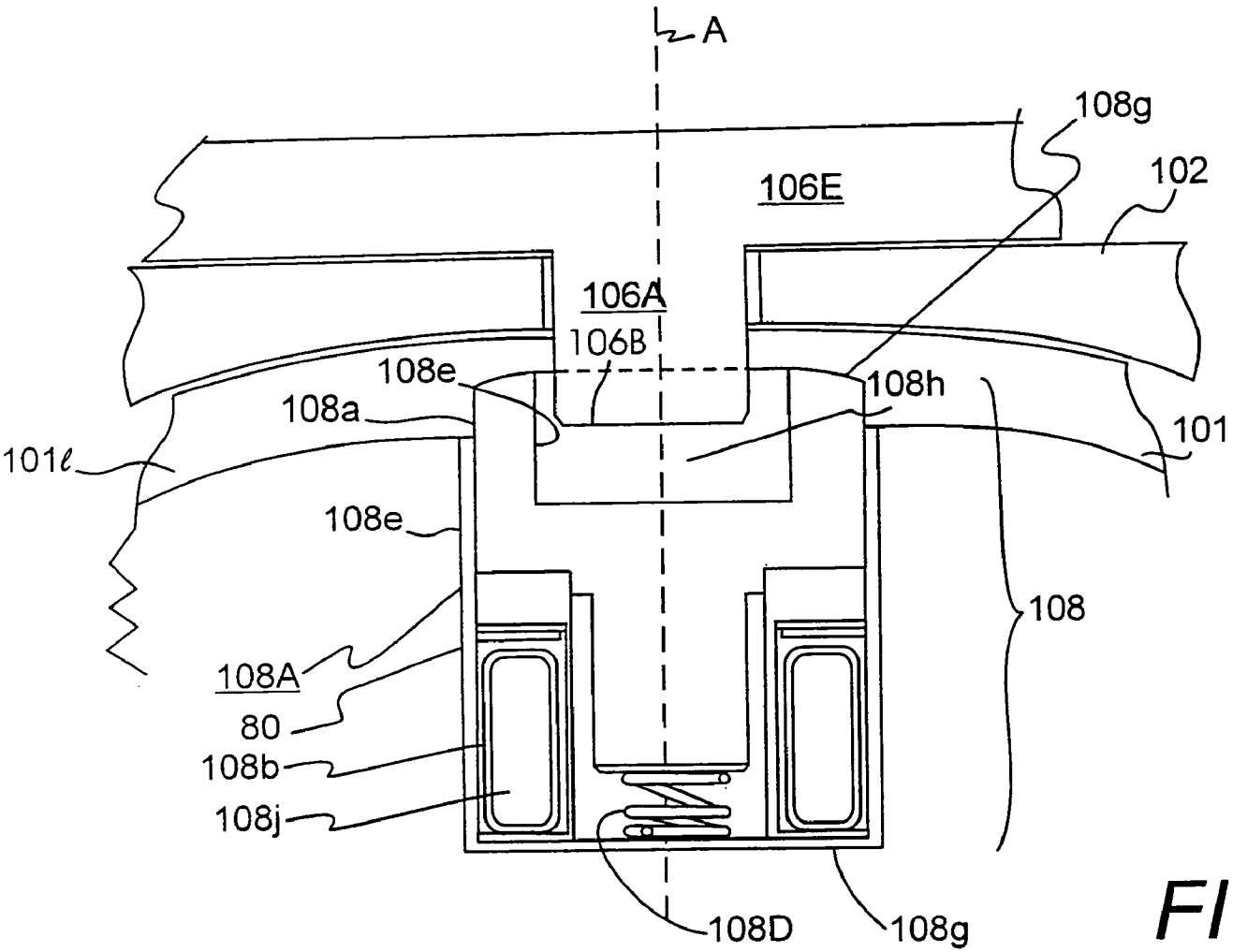
Figure 5C:
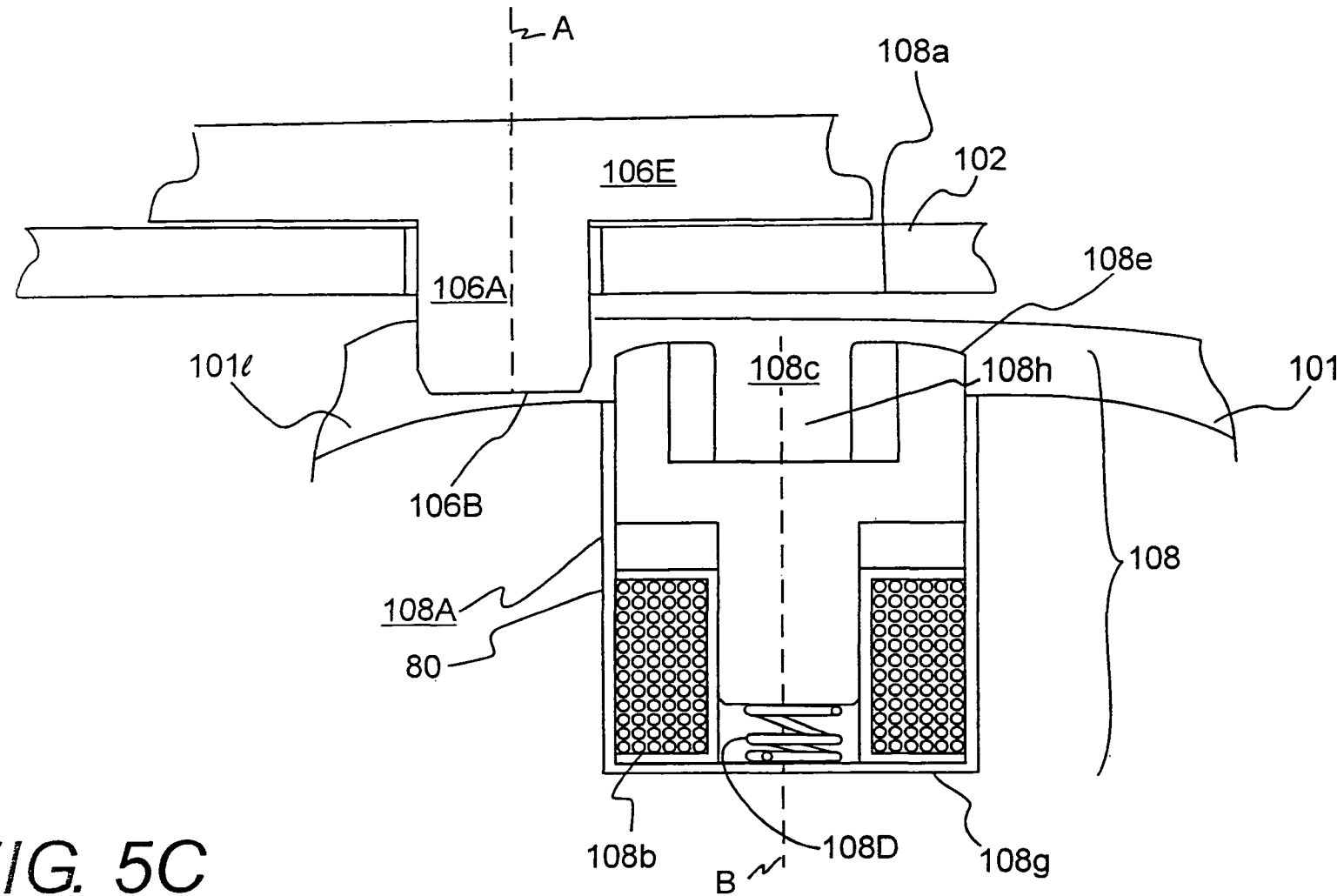
FIG. 5C is a side cross-sectional view of another embodiment, showing one phase of the operation of the lock.
Figure 5D:
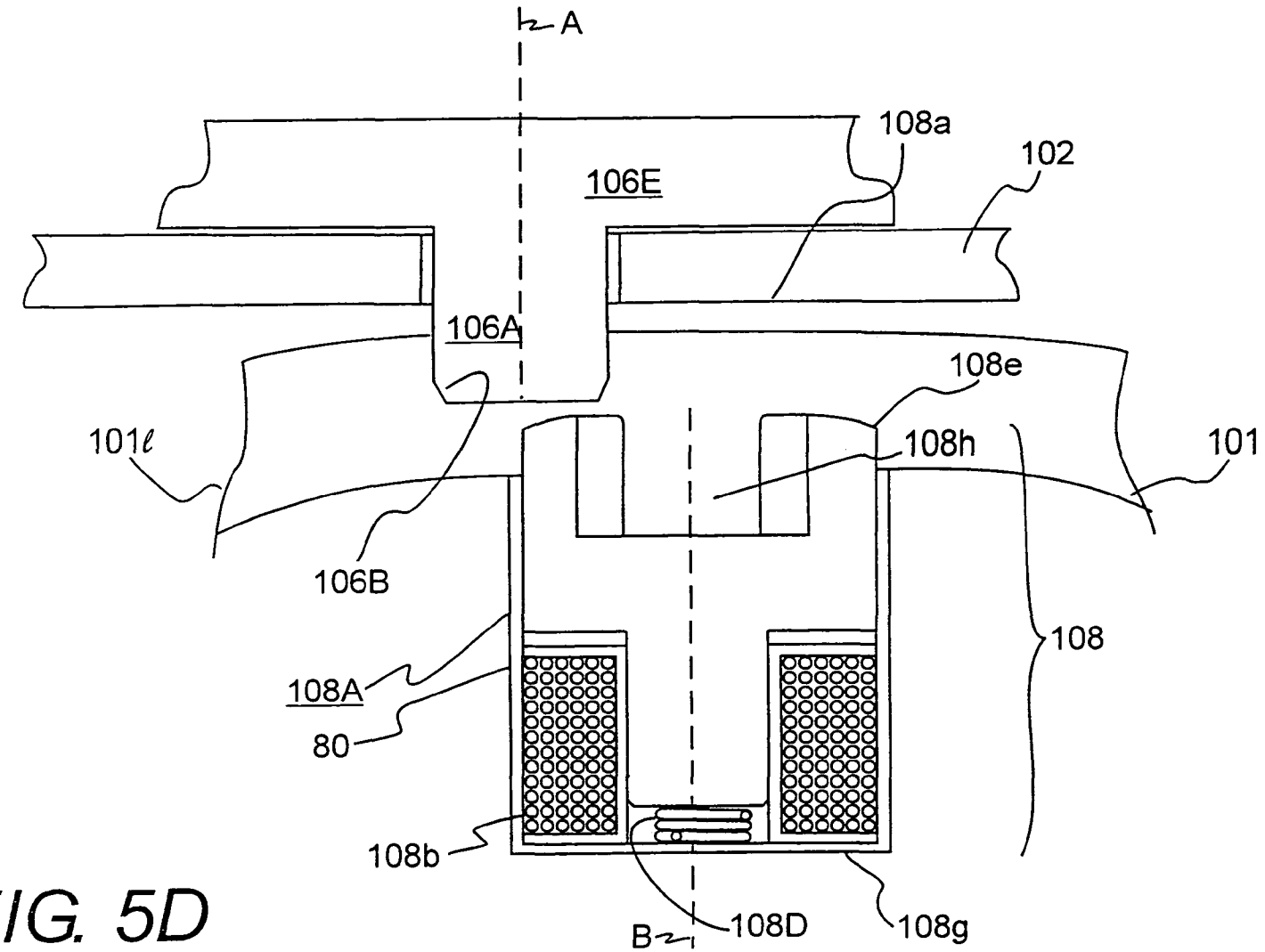
FIG. 5D is a side cross-sectional view of the embodiment illustrated in FIG. 5C, showing another phase of the operation of the lock.
Figure 5E:
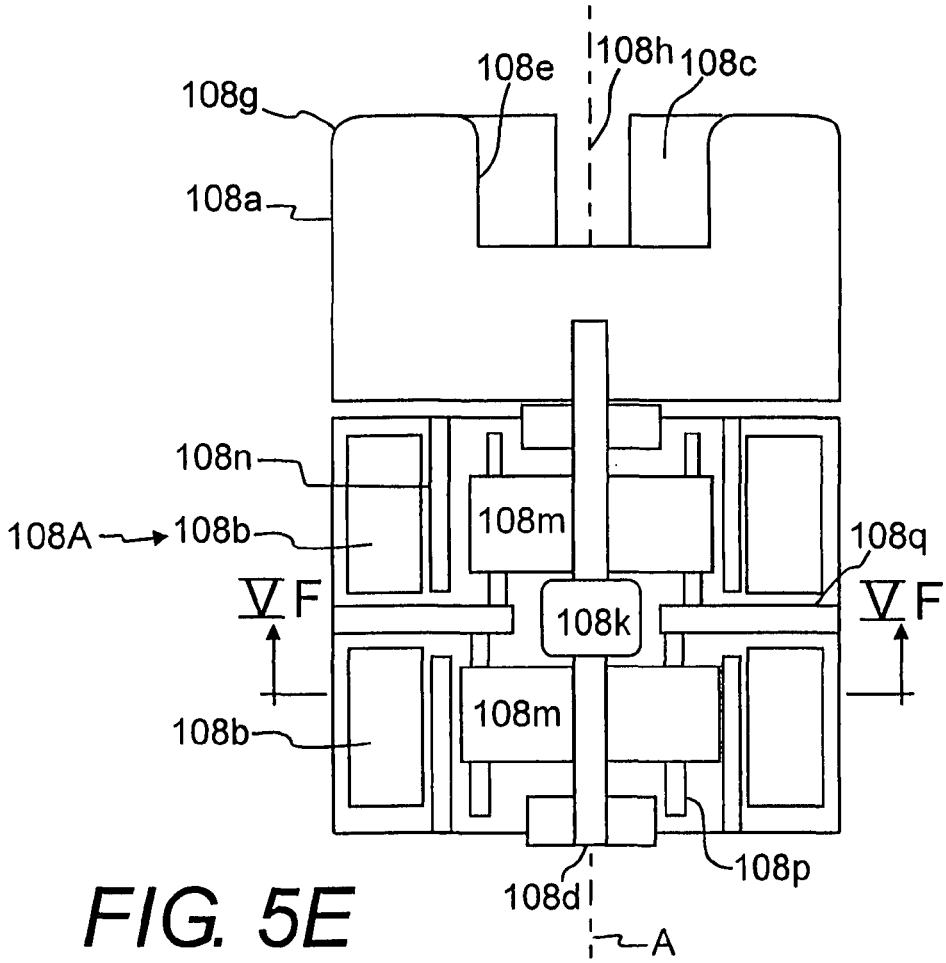
FIG. 5E is a side cross-sectional view of one design for a motor suitable for use in the embodiments shown in FIGS. 5A, 5B, 5C and 5D.
Figure 5F:
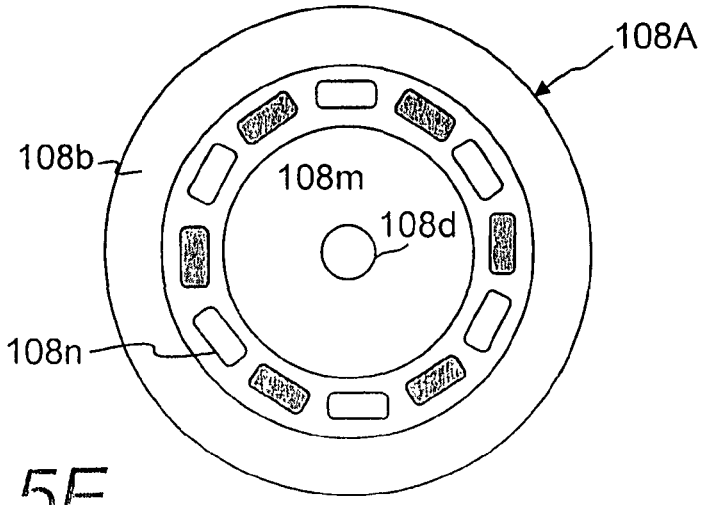
FIG. 5F is a plan cross-sectional view taken along sectional line VF-VF' in FIG. 5E, of one detail of the motor shown in FIG. 5C.
Figure 6:
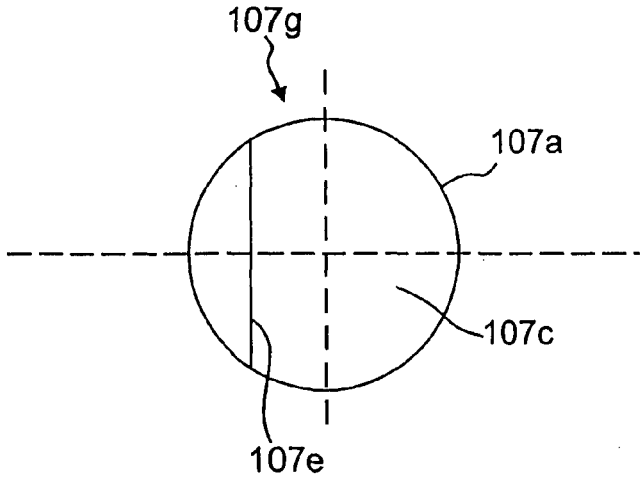
FIG. 6 is a top detailed view of an armature for another electrical operator of a type suitable for use in the embodiment shown in FIG. 1.
Figure 7:
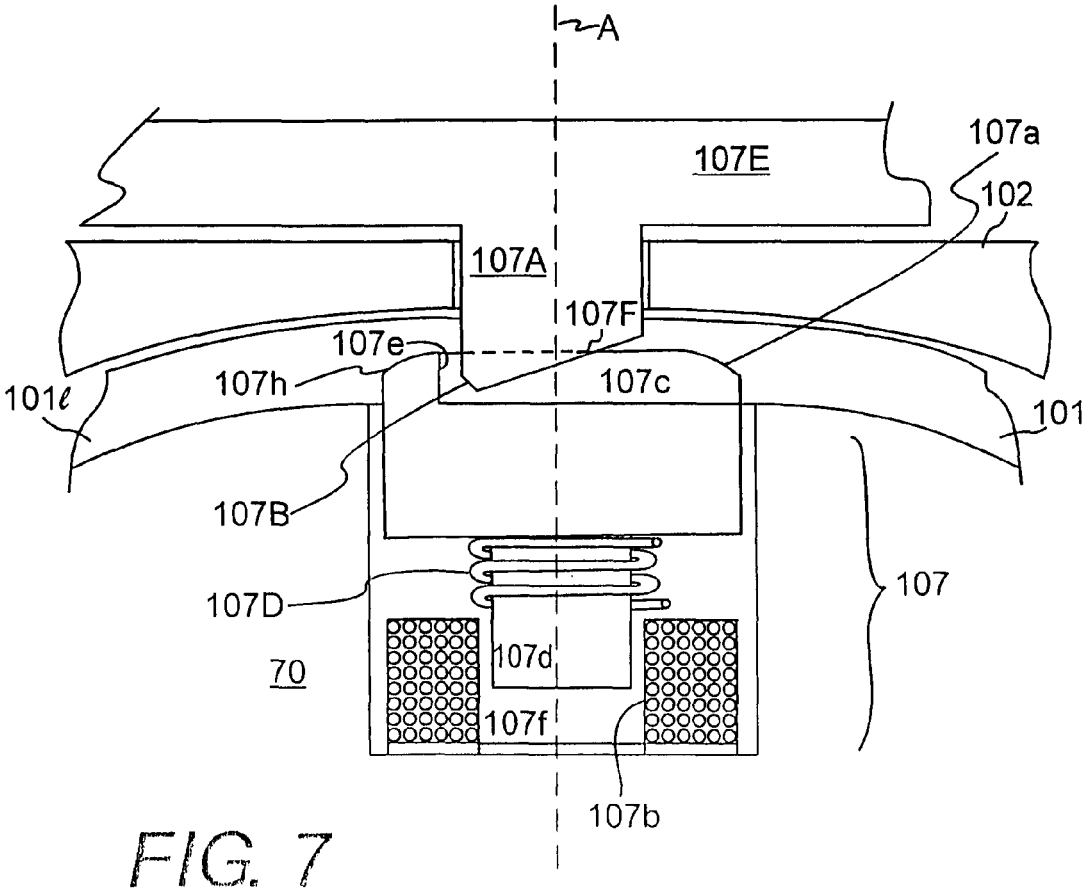
FIG. 7 is an enlarged cross-sectional detailed view showing the structure of the embodiment incorporating the armature illustrated in FIG. 6.
Figure 8A:
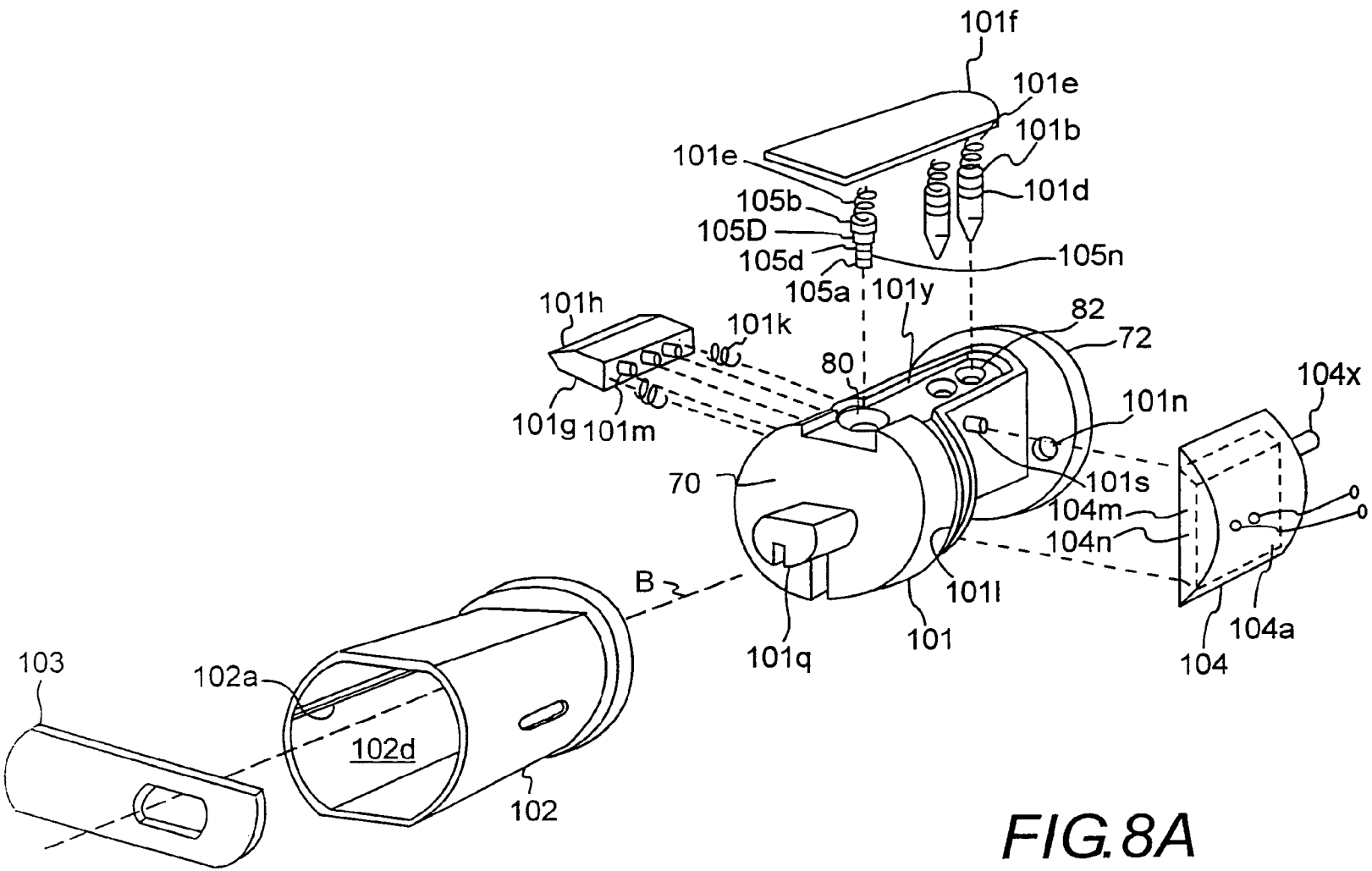
FIG. 8A is an exploded perspective view of another alternative embodiment constructed according to the principles of the present invention.
Figure 8C:
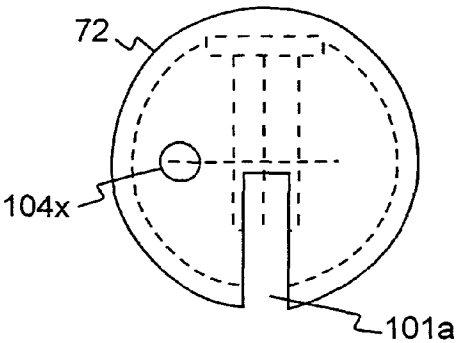
FIG. 8C is a front elevational view of the embodiment illustrated in FIG. 8A.
Figure 8E:
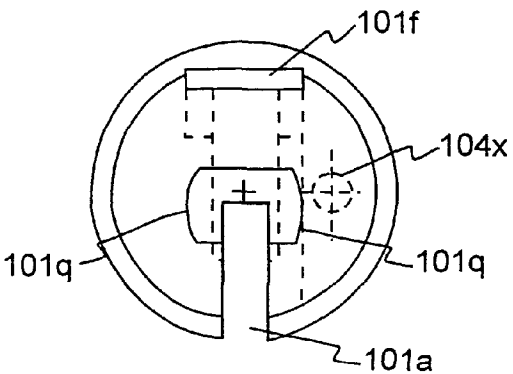
FIG. 8E is a rear elevational view of the embodiment illustrated in FIG. 8A.
Figure 8B:
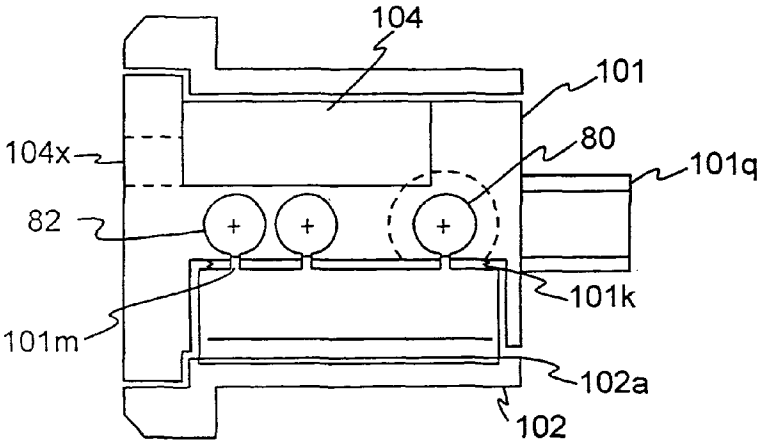
FIG. 8B is an upper plan view of the embodiment illustrated in FIG. 8A.
Figure 8D:
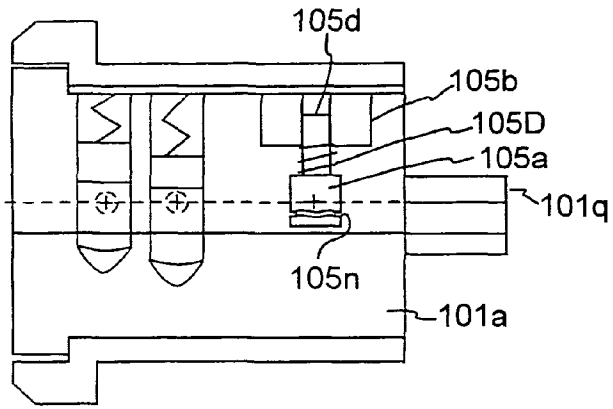
FIG. 8D is a side elevational view of the embodiment illustrated in FIG. 8A.
Figure 8G:
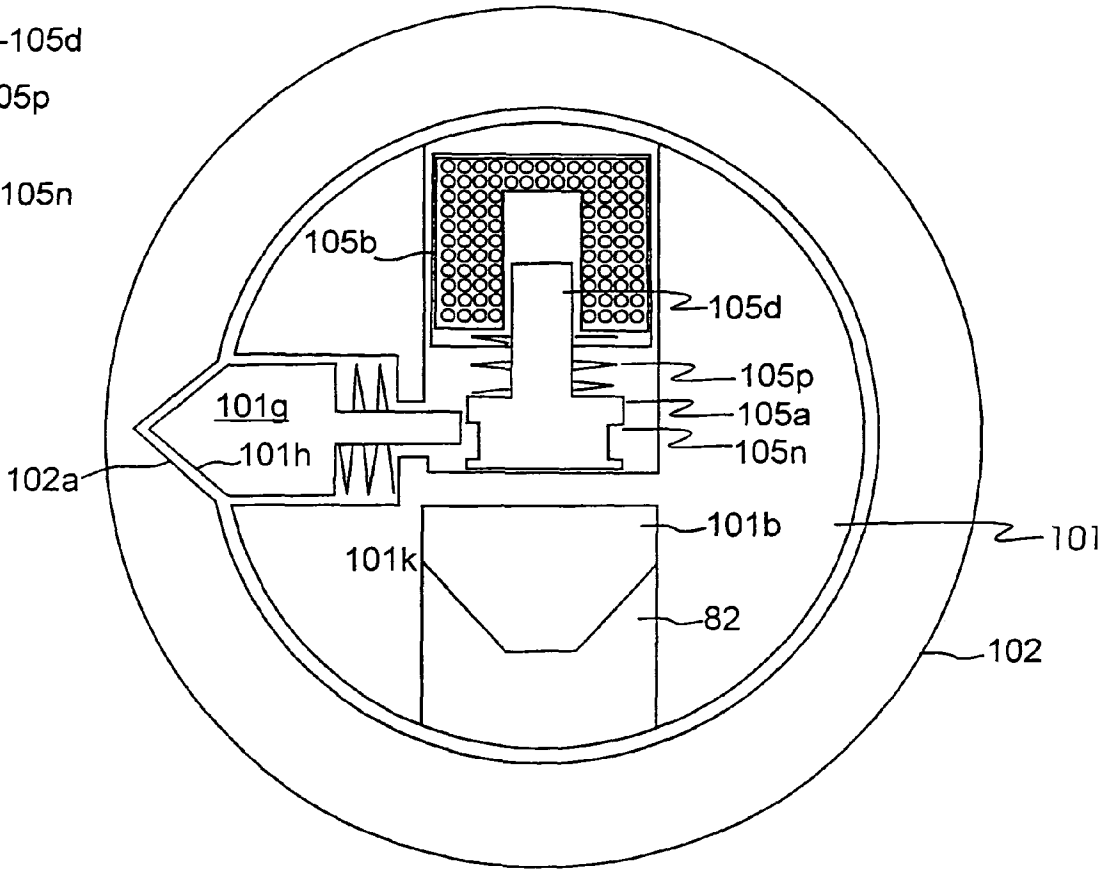
FIG. 8G is a cross-sectional view showing the assembly of the lock illustrated in FIG. 8A.
Figure 8F:
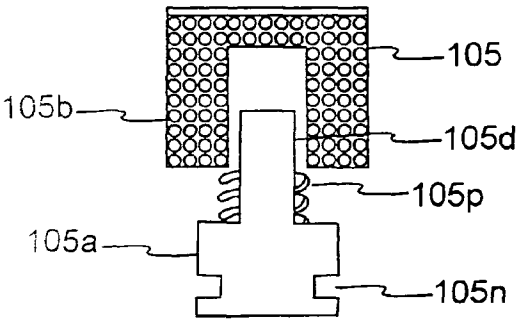
FIG. 8F is a cross-sectional view of an electrical operator of a type suitable for use in the embodiment illustrated in FIG. 8A.
Figure 8H:
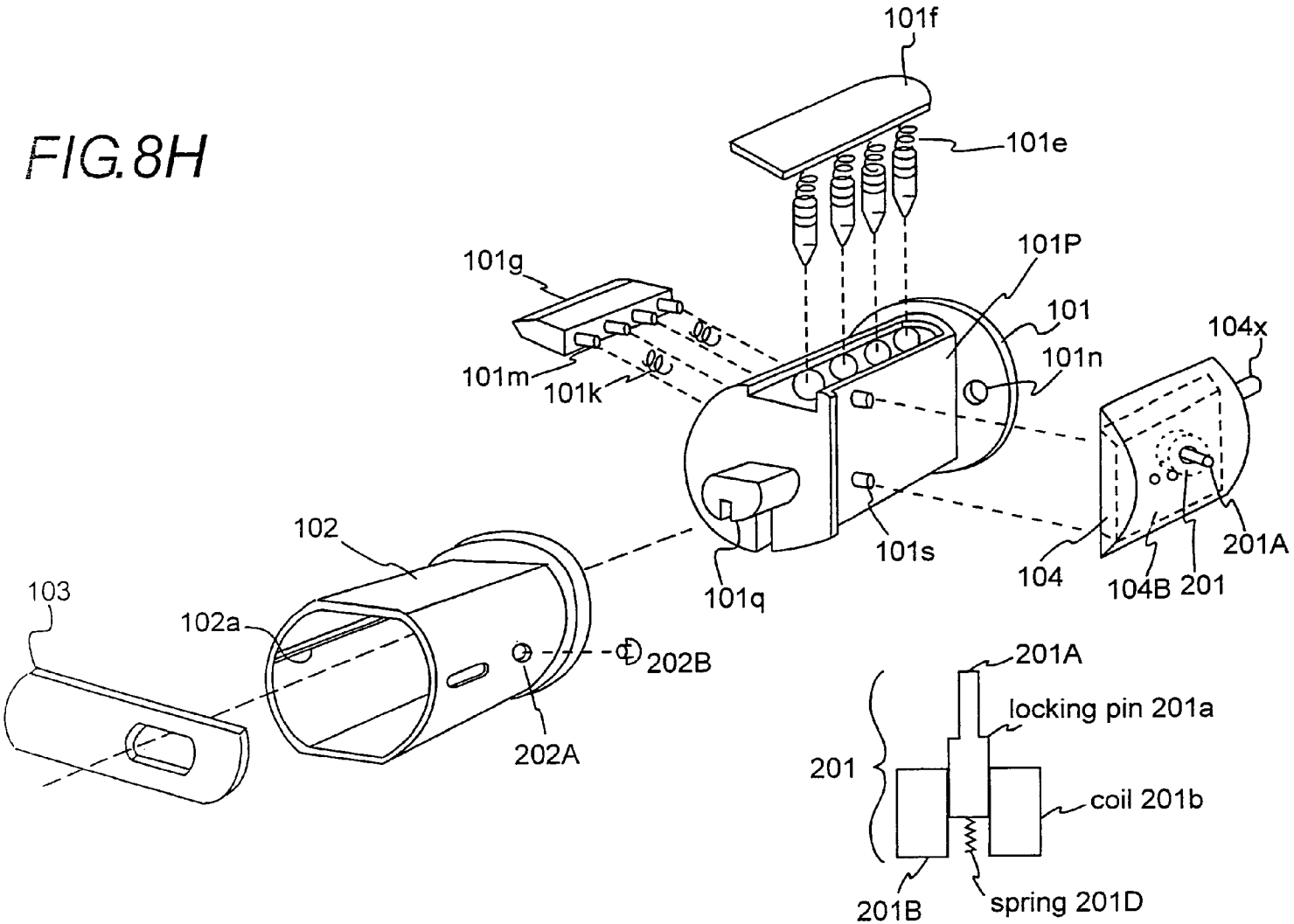
FIG. 8H is an exploded perspective view of another alternative embodiment constructed according to the principles of the present invention.

A release assembly such as a reciprocating solenoid coil 106*b* driving blocking armature 106*a* shown in greater detail in FIGS. 2 and 3, or a rotary motor 108*b* driving blocking armature, 08*a* shown in greater detail in FIGS. 4 and 5A and 5F, or the reciprocating solenoid coil 107*b* of blocking armature 107*a* shown in greater detail in FIGS. 6 and 7, resides within (typically cylindrical) chamber 80. The open distal end of chamber 80 is intersected by a circumferential groove 101*l* which may partially, or completely, encircle the exterior circumferential surface of plug Coil 106*b* has a centrally located hole 106*f* for receiving shaft 106*d* while detent 106A passes either sidewall 106*e* of blocking armature 106*a*. Armature 106*a* forms the radially outward distal end of solenoid coil 106*b*, and is radially outwardly biased by spring 106D so as to extend radially upwardly into the path of groove 101*l* and thereby engage detent 106A. Release assemblies 106, 107, and 108 are electrically connected to an electronic logic and control circuit 104*b* encapsulated within an electrically insulated casing 104 formed to define an outer sector of cylindrical plug 101. Power, or power, protocol, identification and control data may be transmitted from a key inserted into keyway 101*a* via electrical conductor 104*x*, extending between an aperture 101*n* in the faceplate of plug 101 and the electrical conductor (e.g., a local ground return) formed by the electrically conducting parts forming keyway, respectively, and corresponding input ports to circuit 104*b*. Electrical leads 104*m*, 104*n*, extend between a pair of output ports of circuit 104*b* and either solenoid coil 106*c* of blocking armature 106*a*, or solenoid coil 107*c* of blocking armature 107*a*, or motor coils 108*c* of rotary stepping motor 108*a*.

The electrical power or alternatively, electrical power, operational protocol, identification and control data passes through aperture 101*n* via conductor 104*x* when casing 104 is properly positioned within cavity 101*p*. Pegs 101*s* enter corresponding receptacles in casing 104 and position casing 104 relative to plug 101. When casing 104, and its electronic circuit, are seated within plug cavity 101*p*, casing 104 is contained within the larger diameter of plug 101, so that the combined plug assembly formed by plug 101 and electronic circuit casing 104 are easily and tightly received within the interior of lock cylinder 102. Blocking armature 106*a*, 107*a* or 108*a*, may be rendered ineffective at limiting or preventing rotation of plug 101 within cylinder 102 and thus considered to be mechanically bypassed until the installation of a cooperating member clip 105E or 106E, respectively within slot 102*c* with the respective detent 106A, 107A disposed within through aperture 102*b*. A selected one of cooperating member clips 105E or 106E installs circumferentially around cylinder 102 and is seated within a conforming circumferential groove 102*c* when blocking detent 105A or 106A is engaged through slot 102*b*. When installed properly, blocking detent 105A or 106A extends through slot 102*b* and sufficiently into the exposed recess 106*c*, or slot 107*c*, 108*c* in the distal end of the corresponding one of armatures 106*a*, 107*a*, 108*a*, and as plug 101 rotates within cylinder 102, blocking detent 105A, 106A travels through groove 101 around the circumference of plug 101. The shafts 106*d*, 107*d* or 108*d* respectively of blocking armatures 106*a*, 107*a* or 108*a* are made of a magnetically attracted material such as iron or steel. When an unidirectional electrical current is applied through the particular winding 106*b*, 107*b*, 108*b*, the corresponding shaft 106*d*, 107*d*, 108*d* will either axially reciprocate (i.e., radially through its corresponding chamber 82) along axis A or incrementally rotate (e.g., by ninety degrees within its corresponding chamber 82) around axis A and thereby alter the positional relation between blocking detent 106A or 107A relative to the corresponding blocking armature 106*a*, 107*a* or 108*a*.

In the embodiment illustrated by FIGS. 2 and 3, cooperating member clip 106E and blocking armature 106*a* are used as a set to form electromechanical release mechanism 106. When clip 106E is inserted into groove 101P with detent 106A protruding through slot 102*b*, compression spring 106D will hold armature 101*a* radially outwardly from the coaxial void 106*f* formed by coil 106*b*, so that cavity 106*c* will surround detent 106A. Consequently, sidewalls 106*e* will stand between detent 106A and circumferential groove 102P, thereby blocking rotation of plug 101 within cylinder 102. Assuming that mechanical key cuts (i.e., the "bitting" along the shank of a conventional mechanical key 200) correspond with the coding of mechanical pins 101*b*, insertion of a key (not shown) into keyway 101*a* and manual rotation of the key in any direction is blocked by obstruction of detent 106A by stopface 106*e*; application of power to coil 106*b* via contact 104*x* and controller 104, and a responsive reciprocally downward movement of the magnetically attracted blocking armature 106*a* along axis A toward coil 106*b* enables the straight edge 106F of blocking detent 106A to clear the upper edge of stopface 106*e* and to pass freely in that direction within groove 101P. When power is discontinued to coil 106*b*, spring 106D will then return blocking armature 106*a* to its extended position, thereby again blocking rotation of plug 101 in any direction due to obstruction of detent 106A by sidewall 106*e*. If detent 106A is within groove 101*l* and is not axially aligned with cavity 106*c* when application of electrical power is withdrawn from coil 106*b*, continued manual rotation of the key will cause angular edge 107B of detent 106A to engage a slight chamber on the upper edge of armature 106*a* at 106*h*; camming action of edge 106B will force armature 106*a* to axially reciprocate inwardly within its chamber 80 until detent 107A is again engaged by the return outward reciprocating movement of armature 107*a* under the bias of spring 107D. When detent 106A is coaxially aligned with cavity 106*c*, springs 101*k* force edge 101*h* of sidebar 101*g* radially reciprocate outwardly from grooves 101*d* and into groove 102*a*, thereby enabling manual withdrawal of the key from keyway 101*a*.

Turning now particularly to FIGS. 4, 5A, 5B, 5C, 5D, 5E and 5F, when cooperating member clip 106E and blocking armature assembly 106*a* are used as a set to form release mechanism 108, clip 106E will rest within cavity 108*c*, defined by two mirror image and spaced apart sidewalls 108*e* in blocking armature 108*a* while plug 101 is in the locked position relative to cylinder 102 with edge 101*h* of sidebar 101*g* resting within groove 102*a*. Blocking armature 108*a* is coaxially mounted upon the shaft of a stepping motor 108A. As represented in FIGS. 5A, 5B, 5C and 5D, the stepping motor has a single coil 108*b*; the embodiment shown in FIGS. 5E and 5F use a pair of coaxial coils 108*b*. The entire motor assembly is encased in a can 108*j* that is in turn, fitted into cylindrical hole Preferably, stepping motor 108A rotates by ninety degrees in response to application of electrical current to coil, or coils 108*b*. Referring now to FIG. 5A, assuming that upon manual insertion of a key within keyway 101*a*, mechanical key cuts along the shank of the key correspond to coding of the row of mechanical pins 101*b*, rotation of the key in either direction is blocked by engagement of detent 106A with sidewalls 108*e* of cavity 108*c* in blocking armature 108*a*. Turning now to FIG. 5B, application of power to solenoid coil 108*b* and an accompanying rotation of blocking armature 108*a* around axis A relative to coil 108*b* in response to flow of the current, enables the straight lowermost edge 106F of blocking detent 106A to pass through gap 108*h* between opposite sidewalls 108*e* of cavity 108*c* and to pass freely into groove 101X, thereby enabling rotation of plug 101 within cylinder 102. When the key is withdrawn from keyway 101*a*, blocking armature 108*a* will remain in its current position, thereby blocking rotation of plug 101 in either direction if the current position is as shown in FIG. 5A with sidewalls 108*e* interposed between groove 101*l* and detent 106A. If however, the current position of blocking armature 108*a* is as shown in FIG. 5B when the key is withdrawn, detent 106A will be able to freely rotate through gaps 108*h* and into groove 101*l* when another key with the correct bitting is inserted into keyway 101*a*. If tab 106A and cavity 108*g* are significantly misaligned when power is discontinued, then rotation of the plug 101 to the key extraction point where mechanical key retaining pins 101*b* may disengage from the key blade due to the movement of sidebar 101*g* into groove 102*a*, will position small tapered edge 106B to encounter chamber 108*g*. As plug 101 is rotated farther, armature 108*a* is pushed into the void 108*f* coaxially defined by coil 107*b* until tab 106A is again engaged by the return outward movement of armature 108*a*. NMB Corporation currently manufactures a stepping motor, model number 03BJ-H001-F9 of a type that is sufficiently minaturized to serve in this embodiment. This model uses two separately wound coils 108*b*. Application of electrical current to the coils incrementally steps the armature 108*a* to align with the energizied ferrous fingers 108*n* mounted upon the casing and the ferrous fingers 108*p* mounted upon the ferrous divider 108*q*. An electrical insulator 108*k* is mounted on shaft 108*d* to serve as a divider. Reversal of electrical polarity to the coils will cause a reversal of the direction of rotation of armature 108*a*. Preferrably, each application of power to the coils will initiate a ninety degree rotation so that sidewall 108*e* will either block passage of detent 106A into groove 101*l*, or the alignment of slot 108*h* with detent 106A will accommodate passage of detent 106A into groove 101 and thus enable rotation of plug 101 within cylinder 102.

Turning briefly now to FIGS. 6 and 7, when cooperating member clip 107E and blocking armature 107*a* are used as a set to form release mechanism 107, detent 107A of clip 107E will engage stopface 107*e* on blocking armature 107*a*, if plug 101 is rotated in one direction. Assuming that the mechanical key cuts (i.e., the "bitting" along the shank of a conventional mechanical key) correspond with the mechanical pin coding, rotation in one direction is blocked by stopface 107*e* and requires application of power to coil 107*b* and a responsive reciprocally downward movement of the magnetically attracted blocking armature 107*a* toward coil 107*b* so that the straight edge 107F of blocking detent 107A clears the upper edge of stopface 107*e* and passes freely in that direction within groove 101P. When power is discontinued to coil 107*b*, then spring 107D will return blocking armature 107*a* to its extended position, thereby blocking rotation of plug 101 in one direction due to obstruction of stopface 107*e* by detent 107A, while plug 101 is free to rotate in the opposite direction through groove 101*e*. If plug 101 is rotated in this opposite direction far enough, angular edge 107B will engage a slight chamber on the upper edge of armature 107*a* at 107*h*; camming action of edge 107B forces armature 107*a* axially (radially within its chamber 80) inwardly until detent 107A is again engaged by the return outward movement of armature 107*a* under the bias of spring 107D.

FIGS. 8A through 8F illustrate the structure of two different drop-in modifications of a contemporary lock, one without requiring alteration of cylinder 102, and the second requiring a single radial hole into cylinder 102. An elongate, cylindrical plug 101 is axially inserted inside the cylindrical cavity 102*d* of cylinder 102. End plate 68 is recessed to receive faceplate 72 of plug 101. Absent such components of the locking mechanism as cylindrical pins 101*b* and sidebar 101*g*, plug 101 should be sized to freely rotate around an axis B that is parallel to the longitudinal axis of cavity 102*d*. Plug 101 contains an axially elongated keyway passage 101*a* shown in the front, cross-sectional and rear views of FIGS. 10, 11 and 12, respectively, extending axially through exposed plate 72 of cylindrical plug 101. Keyway passage 101*a* is configured to accommodate reciprocal insertion of the blade of a key (not shown) that has been correctly profiled to conform to the profile of keyway 101*a*. Although not essential to the practice of all embodiments of the principles of this invention, plug 101 may also contain a mechanical locking mechanism such as a set of pin tumblers 101*b*. Pin tumblers 101*b* are biased into the bottom of corresponding pin chambers 101*k* by corresponding separate springs 101*e* restrained within the body of plug 101 by coverplate 101*f* covering chambers 80, 82, and fitted snugly into an axially extending slot 101*y* adjacent to the exterior circumferential surface of plug 101.

Plug 101 also contains sidebar 101*g* tapered into an acute (frequently blunted), axially extending bearing edge 101*h* partially recessed into a beveled slot 102*a* formed axially along the exterior circumferential surface of cylinder 102. Sidebar 101*g* is typically biased radially outwardly by one or more springs 101*k* so that the leading axially extending edge 101*h* of sidebar 101*g* protrudes into slot 102*a* of a cylinder 102 encasing plug 101 after the complete plug 101 has been installed into cylinder 102. Pins 101*b* are cut in this particular embodiment with a groove 101*d*, which may be made circular to accommodate rotation of pins 101*b* during insertion of a key. When the blade of a mechanical key that has been bitted to correctly displace pins 101*b* radially outwardly 6 from keyway 101*a* within their corresponding chambers 82 is inserted with the cuts of the land of the key precisely matching the coding (axial separation between the upper and lower portions of pins 101*b*) of pins 101*b*, then slots 101*d* will align with the pegs 101*m* of the sidebar 102*g*. When 9 rotational torque is manually applied to the key by the user, the beveled edges of slot 102*a* enables sidebar 101*g* to move radially inwardly toward plug 101 and away from groove 102*a* against the bias of springs 101*k* slightly, but enough to allow plug 101 to rotate within cylinder 102, thus concomitantly rotating tailpiece 101*q* which, in turn, rotates a movable cam 103 or other member engaged by tailpiece 101*q*.

The user may then rotate the key until plug 101 is aligned with a key extraction point where alignment between chambers 82 and the corresponding tumbler pins 101*b* allow the bias of springs 101*k* to force sidebar 101*g* radially outwardly until beveled edge 101*k* mates with slot 102*a*, and thus permits withdrawal of the key from keyway 101*a*. Two or more grooves, or slots 102*a* may be formed into the interior 102*d*, spaced arcuately apart to provide several arcuately separate points at which a key may be extracted from plug 101. When pins 101*b* are engaged in the properly manufactured corresponding cuts in the blade of the key and each of pins 101*b* is correspondingly radially displaced outwardly within its chamber 82, and pins 101*m* of sidebar 101*g* engage corresponding circular grooves 101*d* formed in some, or all, of pins 101*b* as those pins 101*b* are 2 forced radially outward by the bits of the key. The interengagement of pegs 101*m* and grooves 101*d* prevents radial movement of pins 101*b* and the concomitant release of the blade of the key within 4 keyway 10*l* a; the blade may only be extracted from keyway 101*a* when beveled edge 101*h* of sidebar 101*g* is correctly aligned with groove 102*a*.

A release assembly such as a reciprocating solenoid coil 105*b* driving blocking armature 105*a* resides coaxially within chamber 80. Coil 105*b* has a centrally located hole 105*f* for receiving shaft 105*d* when electrical current passes through coil 105*b*. Armature 105*a* forms the radially 9 outward distal end of solenoid coil 105*b*, and is radially outwardly biased by spring 105D so as to place a circumferential surface 105*k* to engage, and block, a corresponding pin 101*m* of sidebar 101*g*. Release assembly 105 is electrically connected to electronic logic and control circuit 104*b* encapsulated within electrically insulated casing 104 formed to define an outer sector of cylindrical plug 101. Power, or power, protocol, identification and control data may be transmitted from a key inserted into keyway 101*a* via electrical conductor 104*x*, extending between an aperture 101*n* in the face plate 72 and the electrical conductor (e.g., a local ground return) formed by the electrically conducting parts forming keyway, respectively, or alternatively via two or more pairs of apertures 101*n* and electrical conductors 104*x*, and corresponding input ports to circuit 104*b*. Electrical leads 104*m*, 104*n*, extend between a pair of output ports of circuit 104*b* and solenoid coil 105*c* of blocking armature 105*a*.

Solenoid 105*b* enables an existing plug to be retrofitted simply by substituting solenoid 105*a* in chamber 80 for one of tumbler pins 101*b* and a concomitant re-bitting of the corresponding key to omit from the blade of the key any tooth corresponding to the cylinder occupied by solenoid 105*b*, with application of electrical power to solenoid coil 105*b* radially forcing armature 105*a* radially outwardly against the compressive force of spring 101*e* in order to align groove 105*n* with peg 101*m*. Alternatively, with a different location of groove 105*n*, solenoid 105*b* may be wound to draw blocking armature radially downwardly into cylinder 80, against the compressive force of a spring 105D (not shown) positioned between blocking armature 101*a* and coil 105*b*.

In a particular practice, the diameter of one of pin cylinders 80, 82 may not be sufficiently wide to accommodate a particular solenoid and will require reboring of the cylinder. The rebored plug can still be retrofitted into an already installed cylinder however, without the necessity of removing cylinder 102.

Turning again to FIGS. 13 and 17, an existing plug and cylinder may also be modified with the addition of an electromagnetic release assembly 109 to the exterior of cylinder 102, and by radially boring one or more aligned apertures 102*w*, 101*w* through cylinder 102 and into plug 101 to accommodate reciprocal passage of either one, or and array of blocking armatures 109*a*. Power for solenoid coils 109*b* may be supplied and switched by a source of electrical power external to the lock cylinder plug 102 via two or more electrical leads 109E and an external contact assembly 109F which attaches circumferentially around the outside of the cylinder shell 102 and custom multiple spring loaded pin armatures 109*b* passing through the apertures 102*w* bored into the wall of cylinder shell 102 and entering into the corresponding blind apertures 101*w* bored into plug 101 to prevent rotation of plug 101 relative to cylinder shell 102 even after the blade of a correctly bitted key had precisely radially displaced the pin tumblers 101*b*. Installation of contact assembly is made by spreading clip wings 109H apart enough to allow them to pass around cylinder shell 102 to enable contact guide boss 109J to seat into through aperture 102*w* and enter aperture 101*w*, and wing male catch 109G' is firmly engages female catch 109G. The harness 109E is placed so as not to interfere with cam 103 and plug connector 109F may be connected to an external power supply and switching device that is local to the site of the lock, or is connected to a power and control bus to multiple locks.

Power may alternately supplied along with data through plug face contacts 104*x* which is connected to printed circuit 104*b*. Plug face contact 104*x* passes through face plate 72 from the cavity 101*p* to the outside exposed face of the plug via hole 101*n*. In this version data and optionally power may be supplied by the user held door key. A logic circuit with a microprocessor, communication, memory and switching means will be contained in casing 104 and its circuit 104*b*. When key means is presented and inserted in the lock and contacts on key means are in electrical contact with contacts 104, a process of authentication and comparison of encoded data occurs. An agreement of data, will result in the logic circuit switching power to coil 109*b*. In the event there is not an agreement of data then the lock remains in its normal state.

Figure 18:
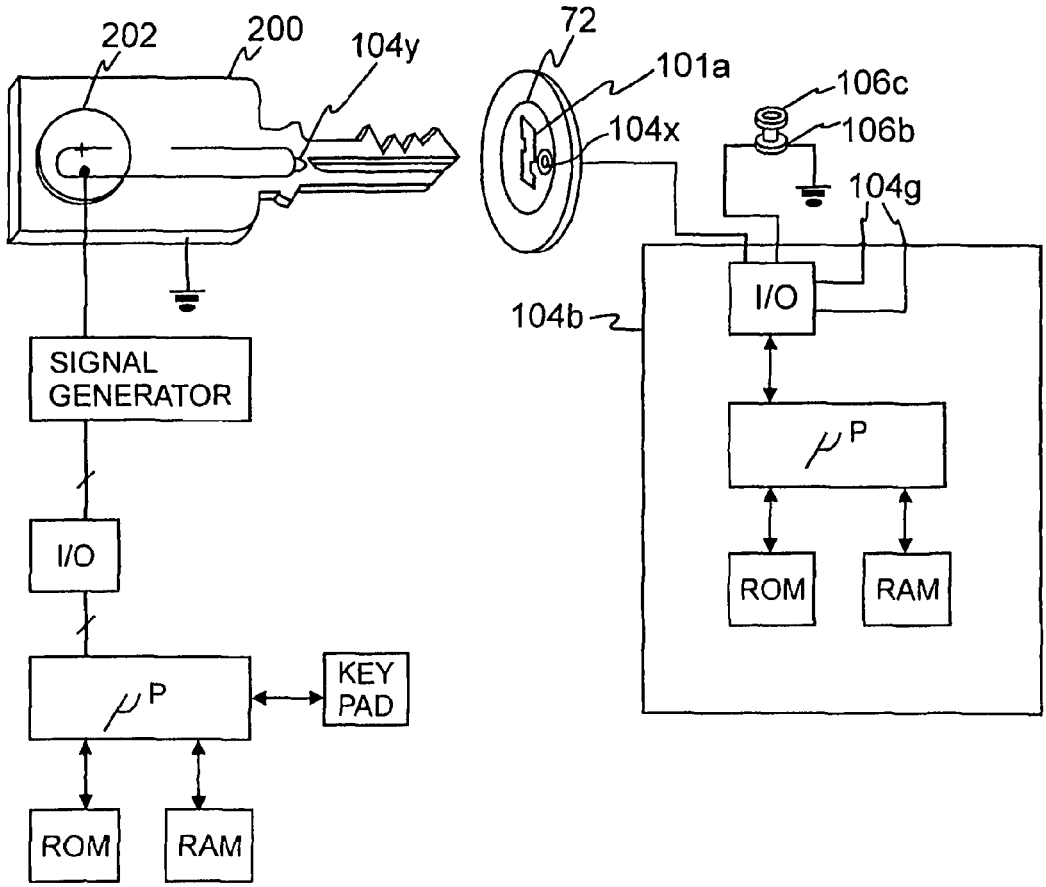
FIG. 18 is a block diagram illustrating circuits for both a key and a lock, constructed according to the principles of the present invention.

Turning now to FIG. 18, power for the coils 105*b*, 106*b*, 107*b* or 108*b* may be supplied and switched by a source of electrical power such a battery 202 carried by a doorkey 200 external to the lock cylinder plug 101 via one or more external contact assemblies 104*x*, 104*y* as are manufactured by a vendor such as Interconnect Devices, Inc. passing through external contact window 101*n*, with contact 104*x* attached to printed circuit 104*b*. The circuit board 104*b* is housed or encapsulated in circuit housing assembly 104 and is electrically connected to coil windings 105*b*, 106*b*, 107*b* or 108*b*.

Figure 19:
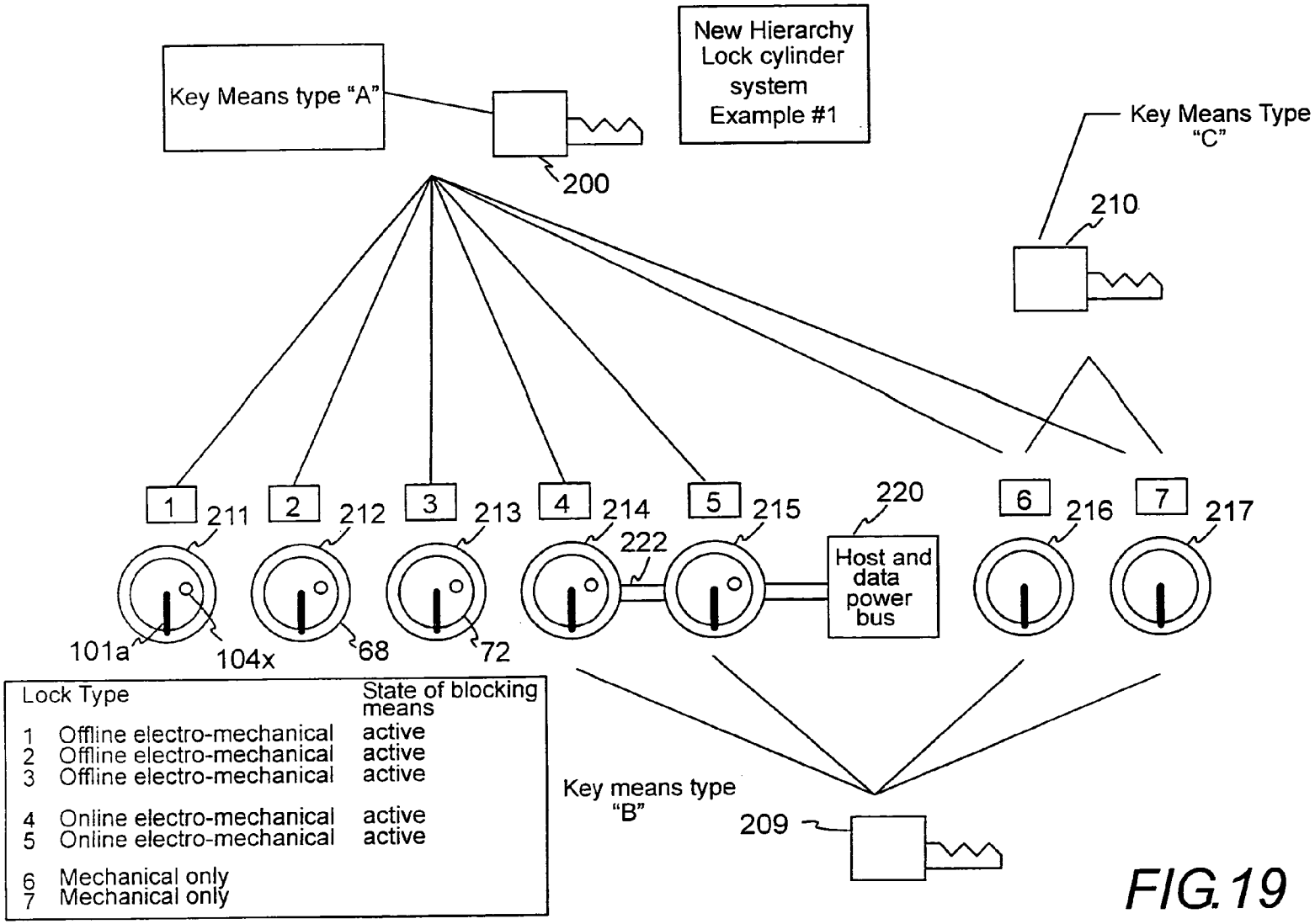
FIG. 19 is a diagrammatic view illustrating one configuration of a hierarchical lock cylinder system practiced according to the principles of the present invention.

One hierarchy for a cylinder lock system is represented in FIG. 19, using a standard, mechanically bitted key 210 in conjunction with electromechanical key 200. In this configuration, cylinder locks 211, 212 and 213 are stand-along locks of the type using release assemblies 105, 106, 107 or 108, that can be opened and closed with electromechanical key 200. Cylinder locks 214, 215 are electrically coupled to a host data and power bus and may be opened and closed with either key 200 or with mechanical key 210, albeit the centrally located controller 220 controls, and overrides where desired, access through locks 214, 215 via power and data bus 222. Cylinder locks 106, 107 are stand-alone mechanical locks and may be accessed by either the correct mechanical bitting of electromechanical key 200 or of mechanical key 210.

Figure 20:
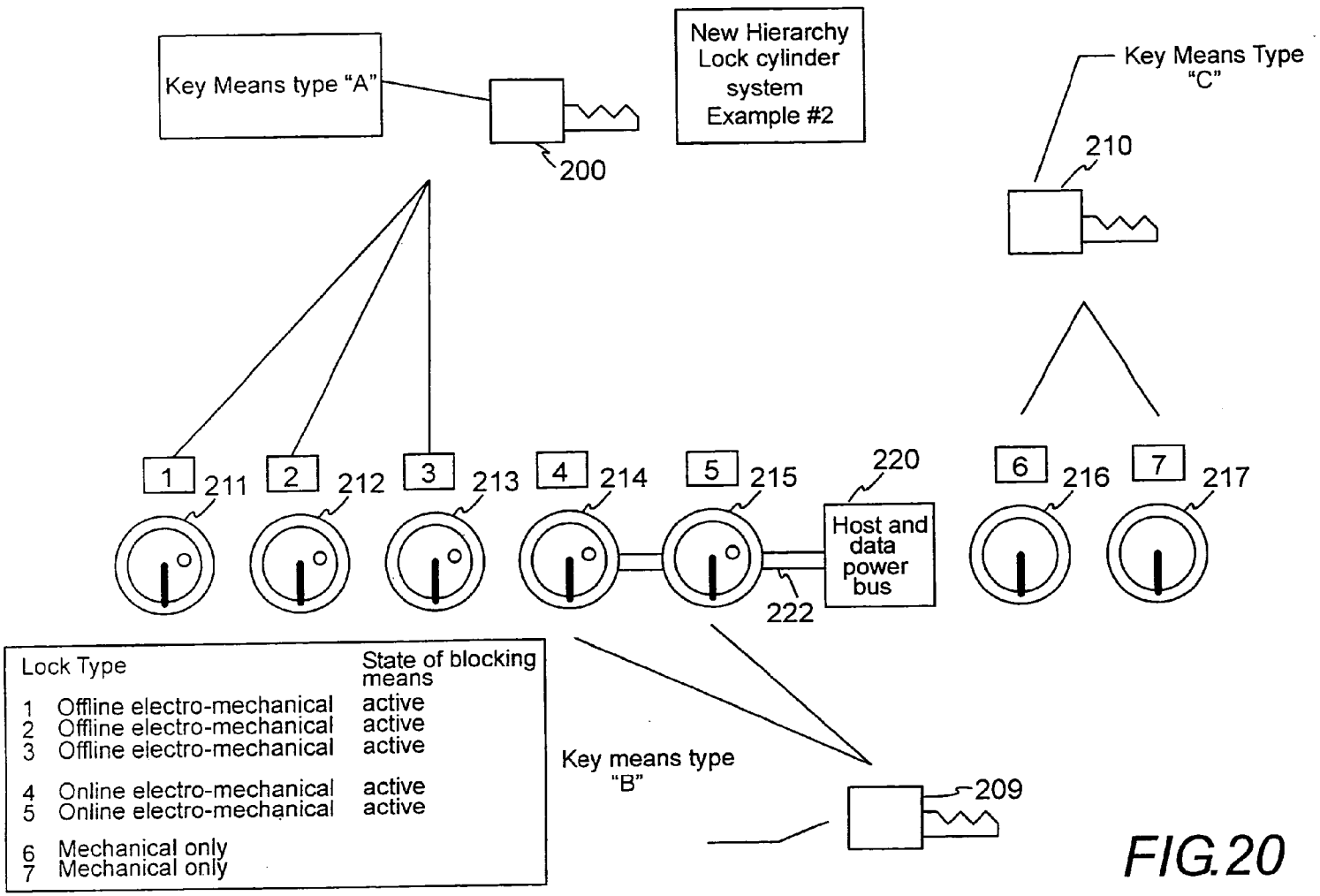
FIG. 20 is a diagrammatic view illustrating a second configuration of a hierarchical lock cylinder system practiced according to the principles of the present invention.

FIG. 20 illustrates a second hierarchy of a cylinder lock system in which electromechanical key 200 providing its own electrical power is able to mechanically and electrically unlock and lock stand-alone electromechanical locks 211, 212, 213 of the types using release mechanisms 105, 106, 107, 108, while a different electromechanical key 209 is able to unlock and lock cylinder locks 214, 215 controlled by a central controller 220 via a host power and data bus 222.

Figure 21:
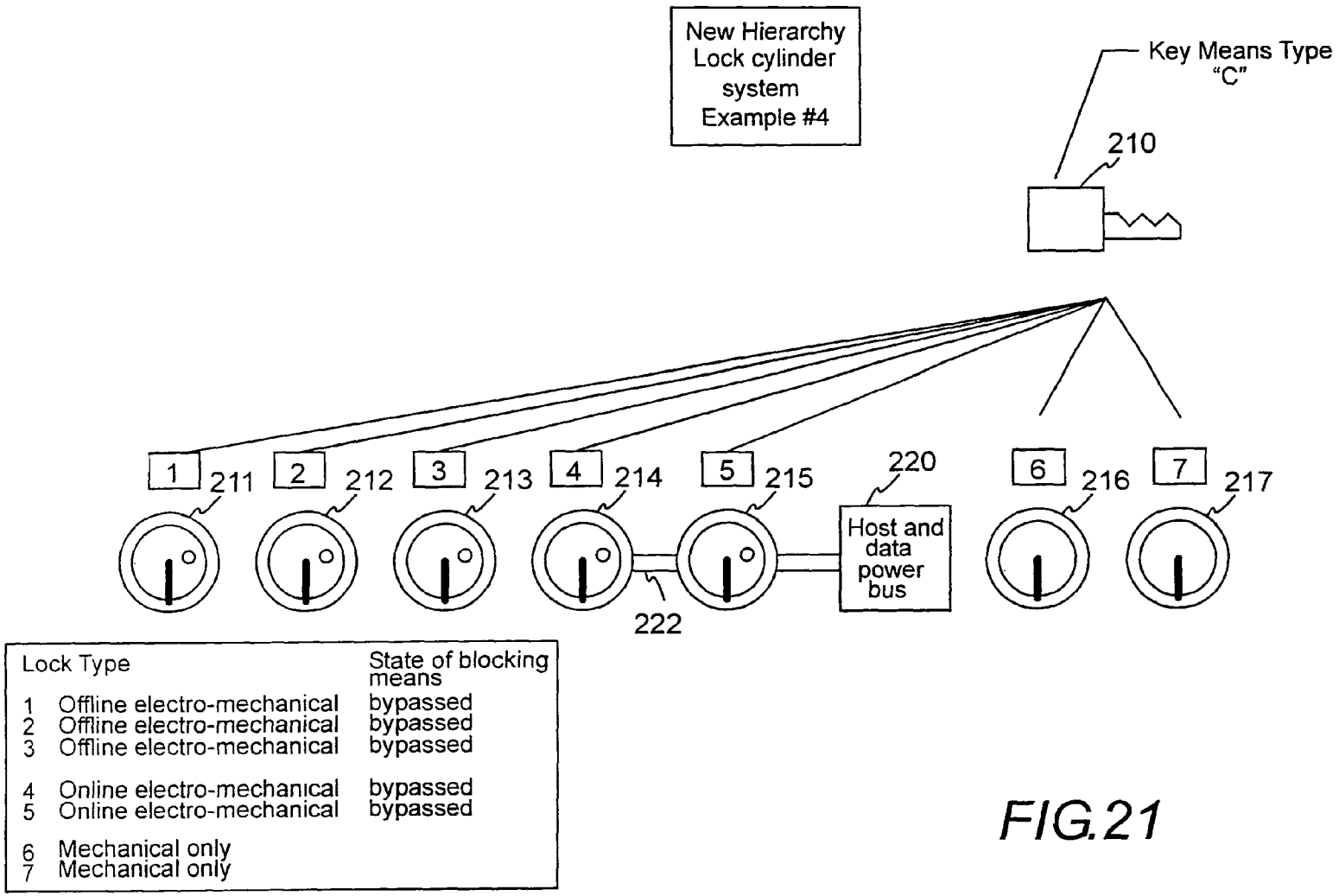
FIG. 21 is a diagrammatic view illustrating a third configuration of a hierarchical lock cylinder system practiced according to the principles of the present invention.

With the configuration illustrated in FIG. 21, electromechanical key 200 is able to unlock and lock all of cylinders 211, 212, 213, 214, 215, 216 and 217, and to set cylinder 213 into a bypassed state to enable mechanical key 209 to unlock and lock cylinder 213.

Figure 22:
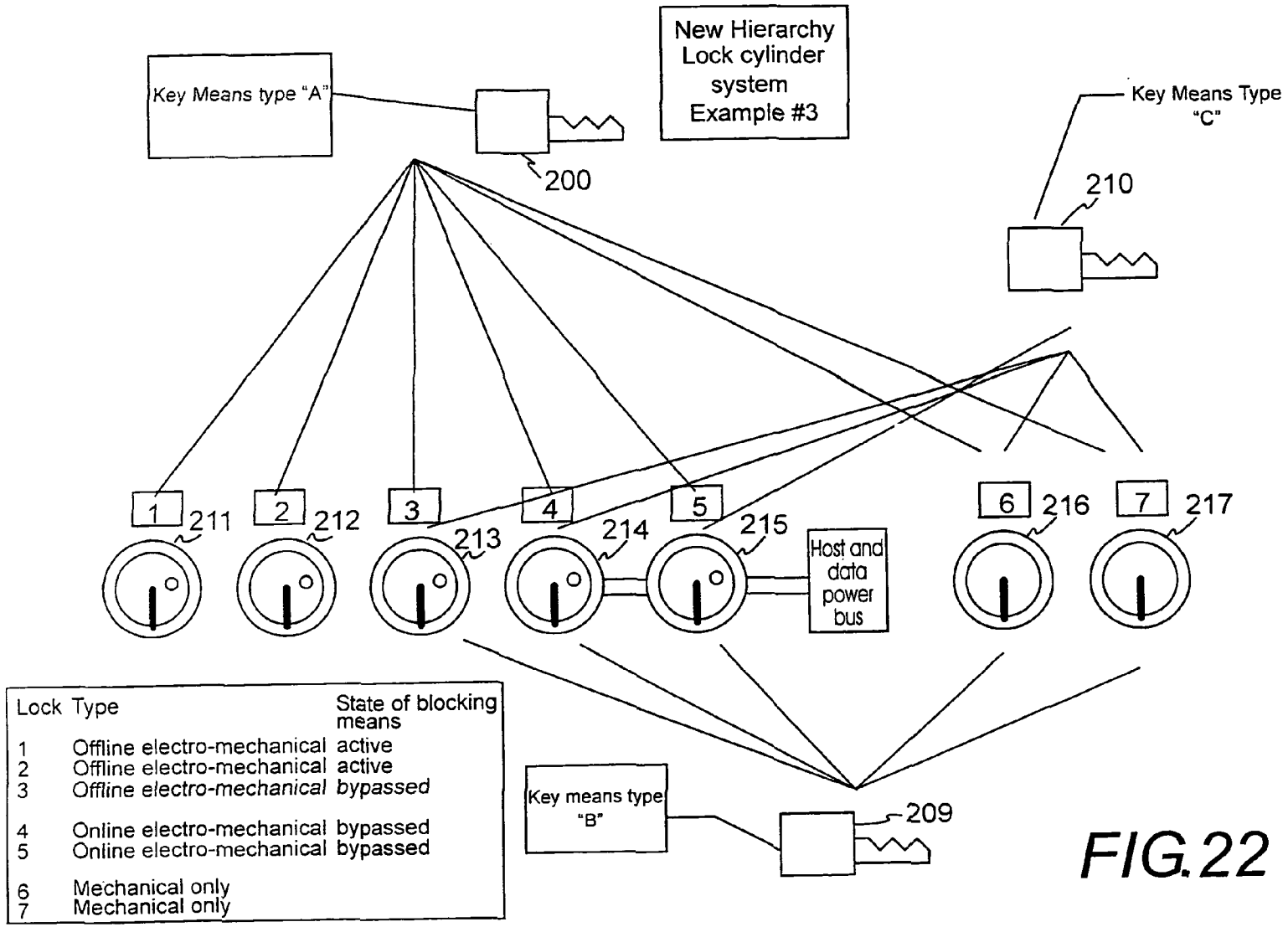
FIG. 22 is a diagrammatic view illustrating one configuration of a hierarchical lock cylinder system practiced according to the principles of the present invention.

In the configuration illustrated in FIG. 22, stand-alone locks 211, 212, 213 using a bypassable release mechanism such as 108, may be set into a bypassed position by key 200 to allow a simple mechanically precisely bitted mechanical key 210 to unlock and lock these cylinders, while either the same key 200 or alternatively host controller 220, is able to set locks 214, 215 into a condition enabling key 210 to unlock and lock those cylinders. Mechanical locks 216, 217 may be independently accessed by key 210.

The foregoing details describe an electromechanical locking system using a plug constructed with a first base bearing a keyway providing a first electrical conductor and an orifice spaced-apart from and separated by a mass of the plug from said keyway; a second base separated by an axial length of the plug from said first base, said second base bearing a tailpiece for supporting a cam; an exterior surface extending between and engaging the first base and the second base; a locking mechanism responsive to a key inserted into said keyway to accommodate rotation of the plug relative to a cylinder surrounding the plug when the key while inserted into the keyway engages in a selected relation with the locking mechanism and engaging the cylinder absent the selected relation; a second electrical conductor terminating with an electrical contact exposed to an exterior of the first base through the aperture; an electronic logic circuit coupled to receive electrical power and data signals via the first and second electrical conductors, and generating control signals in dependence upon the electrical power and data signals; and an electrical operator having a distal member travelling in dependence upon the control signals between a first position relative to the exterior surface enabling rotation of the plug in relation to a cylinder surrounding the plug and a second and different position relative to the exterior surface obstructing the rotation of the plug in relation the cylinder.

The plug of this system is constructed with the locking mechanism, logic circuit and electrical operator simultaneously experiencing the rotation relative to the cylinder whenever the plug rotates relative to the cylinder. The plug is constructed with the locking mechanism, logic circuit and electrical operator being wholly within the cylinder and travelling with the plug whenever the plug moves relative to the cylinder. The plug is configured with the electrical operator maintaining the distal member within the plug with the distal member extended not beyond the exterior surface while the distal member is in the first position, and maintaining the distal member in engagement with the cylinder while the distal member is in the second position. The electrical operator maintains the distal member within the plug with the distal member extending not beyond the exterior surface while the distal member is in the first position, and moves the distal member radially between the first position inside the exterior surface and the second position radially beyond the exterior surface, in dependence upon the control signals.

Alternative construction of these features is possible without departing from the principles of the present invention. For example, the plug used in FIG. 1 to illustrate the foregoing principles is described as having a tailstock configured to support a cam. In some configurations, the plug may be configured to drive either a locking mechanism or an electrical switch.

What is claimed is:

1. A plug, comprising:

a first terminal portion;

a second terminal portion separated by an axial length of said plug from said first terminal portion, said second terminal portion disposed to support a cam, said plug being perforated by a plurality of radially oriented apertures forming an array;

an exterior surface extending between and engaging said first terminal portion and said second terminal portion;

a sidebar positioned between said first terminal portion and said second terminal portion to reciprocate between a first location with said sidebar simultaneously engaging said plug and a cylinder surrounding said plug, and a second location releasing said plug for movement between the cylinder and said plug;

at least one locking mechanism disposed within at least one of said apertures to move relative to said plug in response to a key engaging said first terminal portion to accommodate reciprocation of said sidebar relative to said plug and rotation of said plug relative to the cylinder when the key while said first terminal portion engages in a selected relation with said locking mechanism, said locking mechanism obstructing said reciprocation absent said selected relation;

an electronic logic circuit borne by said plug, generating control signals in dependence upon electrical power and data signals received from the key; and at least one electrical operator comprised of an electrically conducting coil coaxially disposed around an armature within one of said apertures, said sidebar, said logic circuit and said armature being borne by said plug and rotating with said plug relative to the cylinder, said armature travelling in dependence upon said control signals between a first position relative to said exterior surface obstructing said relative movement by engaging said sidebar, and a second and different position relative to said exterior surface accommodating said relative movement.

2. The plug of claim 1, comprising said sidebar, locking mechanism, logic circuit and electrical operator simultaneously experiencing said rotation relative to the cylinder whenever said plug rotates relative to the cylinder.

3. A lock, comprising:

a cylinder containing a hollow recess defining a longitudinal axis and a detent extending from said cylinder;

a plug rotatable around said longitudinal axis while resident within said hollow recess, said plug comprising:

a terminal portion providing an electrical conductor;

a second terminal portion disposed to support a cam;

an exterior surface extending between said first terminal portion and said second terminal portion;

a sidebar borne by said plug to create an obstruction to relative movement between said cylinder and said plug;

a locking device disposed within said plug to release said obstruction when a key engages in a selected relation with said locking device, and to maintain said obstruction absent said selected relation;

an electronic logic circuit borne by said plug, coupled to receive electrical data signals via said electrical conductor, and generating control signals in dependence upon said electrical data signals; and an electrical operator borne by said plug, disposed within an aperture, said operator having a distal member traveling along an axis transverse to said longitudinal axis, in dependence upon said control signals between a first position relative to said exterior surface by engaging said detent and thereby obstructing said movement in concert with said locking device and a second and different position relative to said exterior surface accommodating said movement.

4. The plug of claim 3 comprising said sidebar, locking device, logic circuit and electrical operator simultaneously experiencing said rotation relative to the cylinder whenever said plug rotates relative to the cylinder.

5. A lock, comprising:

a shell containing a hollow recess defining a longitudinal axis and an interior cylindrical surface;

a cylinder plug rotatable around said longitudinal axis while resident within said hollow recess;

a bar borne by said shell and interposed between said shell and said cylinder plug to create an obstruction to rotation of said cylinder plug within said recess;

said cylinder plug comprising:

a first terminal portion and a second terminal portion separated by an axial length of said cylinder plug from said first terminal portion, said second terminal portion configured to support a cam;

a logic circuit generating a control signal in response to a comparison between a code set within said logic circuit and a data signal applied to said logic circuit; and an electrical operator comprised of an electrically conducting coil coaxially disposed with an armature borne by said cylinder plug and rotatable together with said cylinder plug, locking mechanism, logic circuit and electrical operator relative to the shell whenever said cylinder plug rotates relative to the shell, said electrical operator being electrically operable to respond to the control signal by moving the armature independently of said bar between a first orientation accommodating relative movement between said shell and said cylinder plug and a second and different orientation maintaining obstruction of said relative movement while the armature engages said bar.

6. A lock, comprising:

a shell containing a hollow recess defining a longitudinal axis and an interior cylindrical surface;

a cylinder plug rotatable around said longitudinal axis while resident within said hollow recess, said cylinder plug comprising a first base and a second base separated by an axial length of said cylinder plug from said first base, said second base bearing means for supporting a cam;

a bar interposed between said shell and said cylinder plug to travel generally along a radial plane between a first position engaging both said shell and said plug while obstructing rotation of said cylinder plug within said recess, and a second position accommodating said rotation;

a logic circuit generating a control signal in response to a comparison between a code set within said logic circuit and a data signal applied to said logic circuit;

an electrical conductor provided by said plug, conveying said data signal to said logic circuit; and an electrical operator comprising an electrically conducting coil coaxially aligned with an armature, said armature, said bar and said logic circuit being borne by said cylinder plug and rotating around said longitudinal axis with said cylinder plug, said electrical operator being electrically operable to respond to said control signal by moving said armature independently of said travel, between a first orientation providing obstruction of said travel and a second and different orientation accommodating said travel.

* * * * *